US011885215B2

(12) United States Patent
Lafleur

(10) Patent No.: US 11,885,215 B2
(45) Date of Patent: Jan. 30, 2024

(54) DOWNHOLE PRESSURE/TEMPERATURE MONITORING OF ESP INTAKE PRESSURE AND DISCHARGE TEMPERATURE

(71) Applicant: Halliburton Energy Services, Inc., Houston, TX (US)

(72) Inventor: Louis Francis Lafleur, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/575,296

(22) Filed: Jan. 13, 2022

(65) Prior Publication Data

US 2022/0220843 A1 Jul. 14, 2022

Related U.S. Application Data

(60) Provisional application No. 63/137,595, filed on Jan. 14, 2021.

(51) Int. Cl.

| | |
|---|---|
| ***E21B 47/01*** | (2012.01) |
| ***G01D 11/24*** | (2006.01) |
| ***E21B 43/12*** | (2006.01) |
| ***E21B 23/03*** | (2006.01) |
| ***E21B 47/00*** | (2012.01) |
| ***E21B 47/06*** | (2012.01) |

(52) U.S. Cl.

CPC ..... *E21B 47/01* (2013.01); *E21B 23/03* (2013.01); *E21B 43/128* (2013.01); *E21B 47/00* (2013.01); *E21B 47/06* (2013.01); *G01D 11/245* (2013.01)

(58) Field of Classification Search

CPC ..... E21B 47/07; E21B 47/06; E21B 47/008; E21B 23/03; E21B 43/128; E21B 47/01; E21B 47/017

See application file for complete search history.

(56) References Cited

U.S. PATENT DOCUMENTS 4,440,222 A * 4/1984 Pullin ..... E21B 23/03 175/4.51

4,624,309 A 11/1986 Schnatzmeyer (Continued)

FOREIGN PATENT DOCUMENTS

| | | |
|---|---|---|
| EP | 1279795 B1 | 5/2008 |
| NL | 2019644 | 5/2018 |

*Primary Examiner* — Tara Schimpf
*Assistant Examiner* — Yanick A Akaragwe
(74) *Attorney, Agent, or Firm* — Scott Richardson; Parker Justiss, P.C.

(57) ABSTRACT

Provided is a gauge mandrel, a sensing system, and a well system. The gauge mandrel, in one aspect, includes a tubular having a length ($L_t$), an internal diameter ($D_i$) and a width (W), the internal diameter ($D_i$) and the width (W) defining a sidewall thickness (t), the tubular defining a primary fluid passageway. The gauge mandrel, in accordance with this aspect, further includes a gauge cavity extending along at least a portion of the length ($L_t$) of the tubular and located entirely within the sidewall thickness (t), the gauge cavity having an insertion end configured to accept a gauge sensor.

19 Claims, 19 Drawing Sheets

FIG. 5B

(56) References Cited

U.S. PATENT DOCUMENTS

| | | | | |
|---|---|---|---|---|
| 4,660,638 | A | 4/1987 | Yates, Jr. | |
| 5,327,971 | A * | 7/1994 | Garbutt | E21B 47/017 166/372 |
| 5,457,988 | A | 10/1995 | Delatorre | |
| 5,597,042 | A | 1/1997 | Tubel et al. | |
| 5,706,892 | A * | 1/1998 | Aeschbacher, Jr. | E21B 33/127 166/69 |
| 6,116,085 | A | 9/2000 | Moffatt et al. | |
| 6,655,452 | B2 | 12/2003 | Zillinger | |
| 6,915,686 | B2 | 7/2005 | Baustad | |
| 9,347,307 | B2 | 5/2016 | McMillon et al. | |
| 10,253,616 | B2 | 4/2019 | Buck et al. | |
| 2005/0217848 | A1 | 10/2005 | Edwards et al. | |
| 2006/0180305 | A1 | 8/2006 | Gambier et al. | |
| 2006/0185840 | A1 | 8/2006 | Conrad | |
| 2010/0139388 | A1 * | 6/2010 | Griffiths | E21B 47/008 73/152.51 |
| 2013/0220599 | A1 | 8/2013 | Rae | |
| 2015/0008003 | A1 | 1/2015 | Afleur | |
| 2020/0109619 | A1 | 4/2020 | Coste et al. | |

* cited by examiner

DOWNHOLE PRESSURE/TEMPERATURE MONITORING OF ESP INTAKE PRESSURE AND DISCHARGE TEMPERATURE

CROSS-REFERENCE TO RELATED APPLICATION

This application claims the benefit of U.S. Provisional Application Ser. No. 63/137,595, filed on Jan. 14, 2021, entitled "PERMANENT DOWNHOLE PRESSURE/TEMPERATURE MONITORING OF ESP INTAKE PRESSURE AND DISCHARGE TEMPERATURE," commonly assigned with this application and incorporated herein by reference in its entirety.

BACKGROUND

Electric submersible pumps (ESPs) may be deployed for any of a variety of pumping purposes. For example, where a substance (e.g., hydrocarbons in a subterranean formation) does not readily flow responsive to existing natural forces, an ESP may be implemented to artificially lift the substance. If an ESP fails during operation, the ESP must be removed from the pumping environment and replaced or repaired, either of which results in a significant cost to an operator.

The ability to predict an ESP failure, for example by monitoring the operating conditions and parameters of the ESP, provides the operator with the ability to change the operation of the ESP, perform preventative maintenance on the ESP or replace the ESP in an efficient manner, reducing the cost to the operator. However, when the ESP is in a wellbore, it is difficult to monitor the operating conditions and parameters with sufficient accuracy to accurately predict ESP failures.

BRIEF DESCRIPTION

Reference is now made to the following descriptions taken in conjunction with the accompanying drawings, in which.

DETAILED DESCRIPTION

Figure 1:
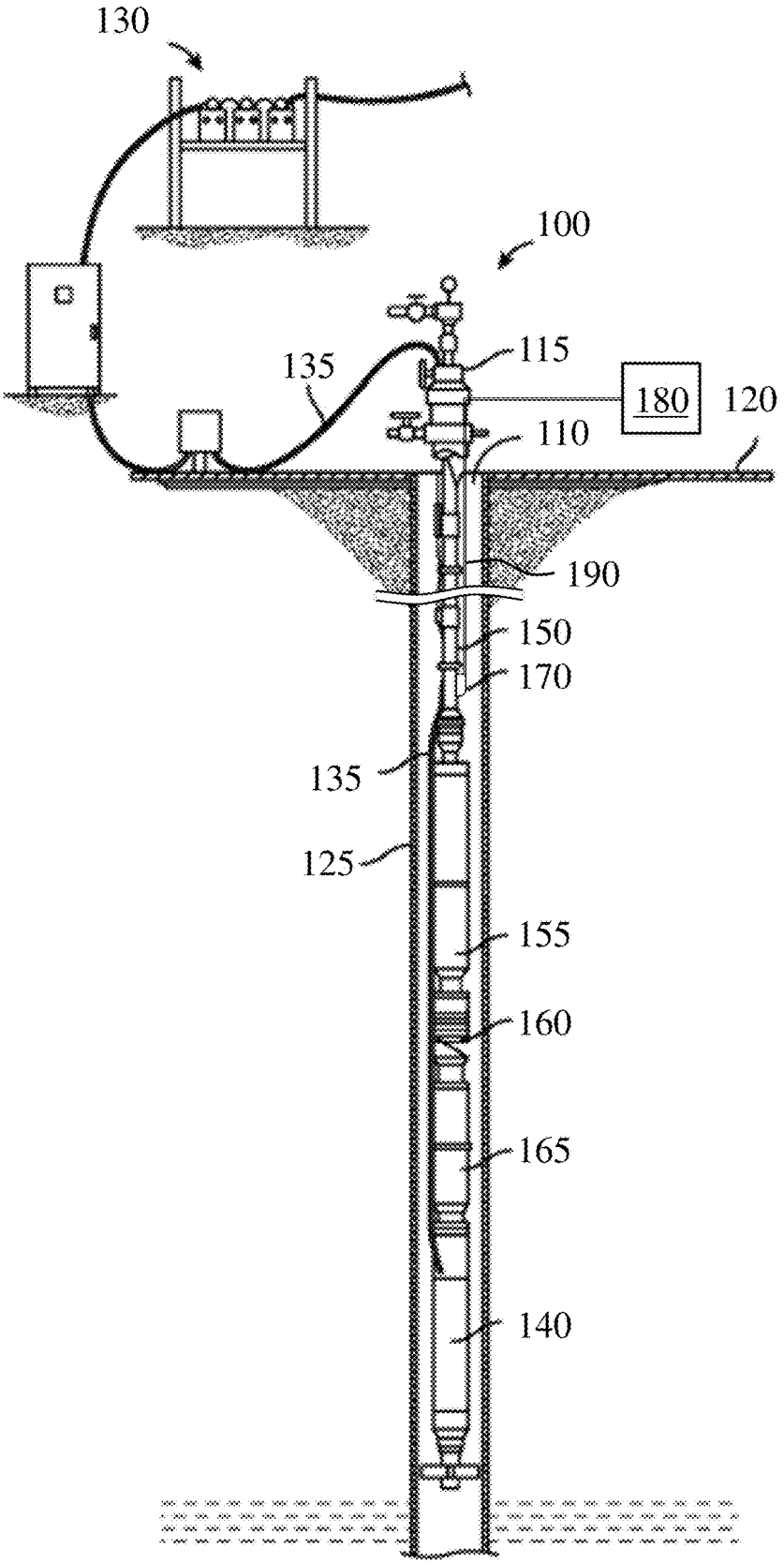
FIG. 1 illustrates a perspective view of a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as seawater or fresh water.

Typical downhole pressure/temperature gauges (e.g., permanent downhole pressure/temperature gauges) have the pressure and temperature sensors in close proximity. The downhole pressure/temperature gauges are typically mounted on the exterior of the tubing string and can be ported to measure the pressure of either the tubing or the annulus. This presents a challenge when monitoring the temperature inside the tubing while also monitoring the pressure in the annulus, which at a very minimum would require two separate sensors.

Accordingly, the present disclosure provides a novel sensing system, which is a combination of a downhole pressure/temperature gauge sensor and gauge mandrel (e.g., permanent downhole pressure/temperature gauge and gauge mandrel in one embodiment). In at least one embodiment, the gauge sensor is installed inside the gauge mandrel and employs one or more seals (e.g., metal to metal seals) to secure the gauge sensor and maintain wellbore integrity. In at least one embodiment, a downhole end of the gauge sensor is configured with a pressure nipple which extends out of the downhole end of the upset of the gauge cavity in the gauge mandrel to enable monitoring of the annulus, which may also be the ESP intake pressure. This design can also be configured such that the gauge sensor monitors the pressure and temperature inside the tubing string.

A novel sensing system according to the disclosure may have many different unique features. In at least one embodiment, the gauge sensor may be installed in a gauge cavity (e.g., as opposed to a slot) inside the gauge mandrel. In at least one other embodiment, the gauge cavity may be bored inside a sidewall thickness (t) of the gauge mandrel (e.g., the upset of the gauge mandrel) for the gauge sensor to insert within. In yet another embodiment, the gauge sensor (e.g., gauge sensor housing) may have an angled surface on the gauge insertion end that is configured to engage with an opposing angled surface in the gauge cavity of the gauge mandrel to create a metal to metal seal.

In at least one embodiment, the gauge cavity has an insertion end entering the sidewall thickness (t) and an exit end exiting the sidewall thickness (t). In at least one embodiment, the insertion end of the gauge cavity has threads to enable the use of a gland to drive the gauge sensor into the gauge cavity and energize the metal to metal seal. Similarly, in at least one embodiment the exit end of the gauge cavity incorporates threads and a seal surface, for example to secure a pressure nipple of the gauge sensor. In at least one embodiment, the pressure nipple extends through the exit end of the gauge cavity and into an annulus, and a pressure nipple fitting engages with the threads in the exit end of the gauge cavity to secure the pressure nipple. In at least one embodiment, a compression fitting may be installed to create a metal to metal seal between the gauge sensor and the gauge mandrel at the exit end. The pressure nipple can either be bored through to enable monitoring the annulus pressure, or ESP intake pressure, or the pressure nipple can have a closed end with perforations along its length to measure tubing pressure. In this embodiment, the gauge sensor might have a single temperature sensor and a single pressure sensor. In yet another embodiment, the gauge sensor might have a single temperature sensor and a pair of pressure sensors (e.g., one to measure the annulus pressure and another to measure the tubing pressure). In yet another embodiment, the gauge sensor might have a pair of temperature sensors (e.g., one to measure the tubing temperature and another to measure the annulus temperature) and a pair of pressure sensors (e.g., one to measure the annulus pressure and another to measure the tubing pressure).

In at least one embodiment, the gauge mandrel may also have one or more fluid passageways (e.g., one or more machined fluid passageways) in the sidewall thickness (t) coupling the tubular and the gauge cavity. This allows fluid flowing through the tubular to enter the gauge cavity via the one or more fluid passageways and surround the gauge sensor so the gauge sensor can obtain the most accurate measurement, whether it be temperature and/or pressure.

In at least one embodiment, the method used to mount the gauge sensor to the gauge mandrel and create the metal to metal seals does not induce mechanical strain on the sensors of the gauge sensor, which could induce errors in the measurements. In at least one other embodiment, one or more of the metal to metal seals (e.g., at opposing ends of the gauge cavity) are pressure testable, and thus in certain embodiments there is no need to pressure test the gauge mandrel to confirm that the metal to metal seals are assembled correctly.

The term insertion end and exit end, as used herein, are in reference to the end of the gauge cavity that the gauge sensor inserts into, as well as the end of the gauge cavity that the gauge sensor could exit from. In many embodiments, the insertion end is an uphole end, and the exit end is downhole of the insertion end. Nevertheless, the opposite may be true.

One or more additional advantages of the novel sensing system, include: requires minor modifications to the mechanical packaging of existing downhole pressure/temperature gauges; enables monitoring of ESP intake pressure (e.g., annulus pressure) and discharge temperature (e.g., tubing temperature) in a single gauge package; does not require multiple gauge sensors or "splitting" of a TEC downhole; no welds on the gauge mandrel; gauge mandrel can be manufactured with conventional methods and tooling; standard/common gauge mandrel design can be used for monitoring either the tubing pressure or the annulus pressure; metal to metal seals can be pressure tested in the field without requiring a pressure test of the gauge mandrel or tubing string; single component of the gauge sensor may be changed to monitor tubing pressure or annulus pressure; can be used with any ESP as it is installed in the production tubing; suitable for SAGD or Geothermal applications, as it can accommodate the high temperatures (e.g., 260° C. and 315° C.) used with Datasphere® ERD™ HT or Datasphere® ERD™ XHT gauges.

Referring to FIG. 1, depicted is a perspective view of a well system 100 including an exemplary operating environment that the apparatuses, systems and methods disclosed herein may be employed. For example, the well system 100 could use a gauge mandrel and/or gauge sensor according to any of the embodiments, aspects, applications, variations, designs, etc. disclosed in the following paragraphs. The well system 100, in the illustrated embodiment, includes a wellbore 110 having a wellhead 115 at a surface 120 thereof. The wellbore 110 extends and penetrates various earth strata, including in certain embodiments hydrocarbon containing subterranean formations.

A casing 125 can be cemented along a length of the wellbore 110. Nevertheless, in certain other embodiments the wellbore 110, or at least a portion thereof, is an open hole wellbore. A power source 130 can have an electrical cable 135, or multiple electrical cables, extending into the wellbore 100 and coupled with a motor 140. It should be noted that while FIG. 1 generally depicts a land-based operation, those skilled in the art will readily recognize that the principles described herein are equally applicable to subsea operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like.

Disposed within the wellbore 110 can be a tubing string 150 having an ESP 155 forming an electric submersible pump string. The ESP 155 may be driven by the motor 140. The tubing string 150 can also include a pump intake 160 for withdrawing fluid from the wellbore 110. The pump intake 160, or pump admission, can separate the fluid and gas from the withdrawn hydrocarbons and direct the fluid into the ESP 155. A protector 165 can be provided between the motor 140 and the pump intake 160 to prevent entrance of fluids into the motor 140 from the wellbore 110. The motor 140 can be electrically coupled with the power source 130 by the electrical cable 135. The motor 140 can be disposed below the ESP 155 within the wellbore 110, among other locations. The ESP 155 can provide artificial pressure, or lift, within the wellbore 110 to increase the withdrawal of hydrocarbons, and/or other wellbore fluids. The ESP 155 can provide energy to the fluid flow from the well thereby increasing the flow rate within the wellbore 110 toward the wellhead 115.

The tubing string 150 can be a series of tubing sections, coiled tubing, or other conveyance for providing a passageway for fluids. In at least one embodiment, a gauge mandrel 170 is interposed within the tubing string 150, the gauge mandrel 170 having a gauge sensor (not shown, but including a temperature and/or pressure sensor) disposed therein. The gauge sensor, in the disclosed embodiment, is configured to determine the temperature and/or pressure within the tubing string 150, and/or as well as within the annulus between the wellbore 110 and the gauge mandrel 170, or any combination of the foregoing. Accordingly, the gauge sensor may be coupled with sensor technology 180 via a wire 190 (e.g., TEC conductor). The gauge mandrel 170 may include one or more of the novel features as disclosed within the present disclosure, including a gauge cavity extending along at least a portion of a length ($L_t$) of its tubular and located entirely within a sidewall thickness of the tubular.

Figure 2A:
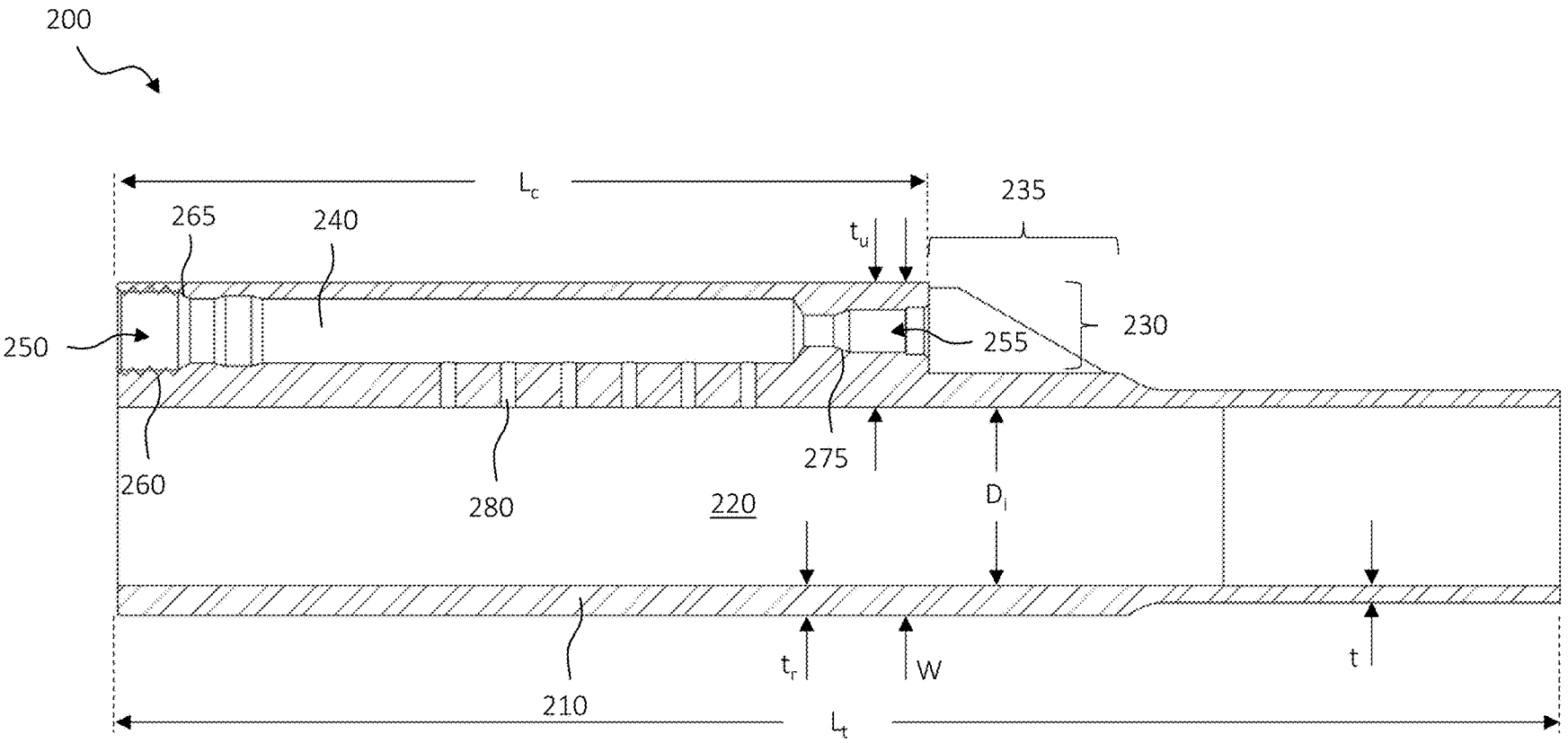
FIGS. 2A and 2B illustrate a cross-sectional view and top view, respectively, of one embodiment of a gauge mandrel designed, manufactured and/or operated according to one or more embodiments of the disclosure.
Figure 2B:
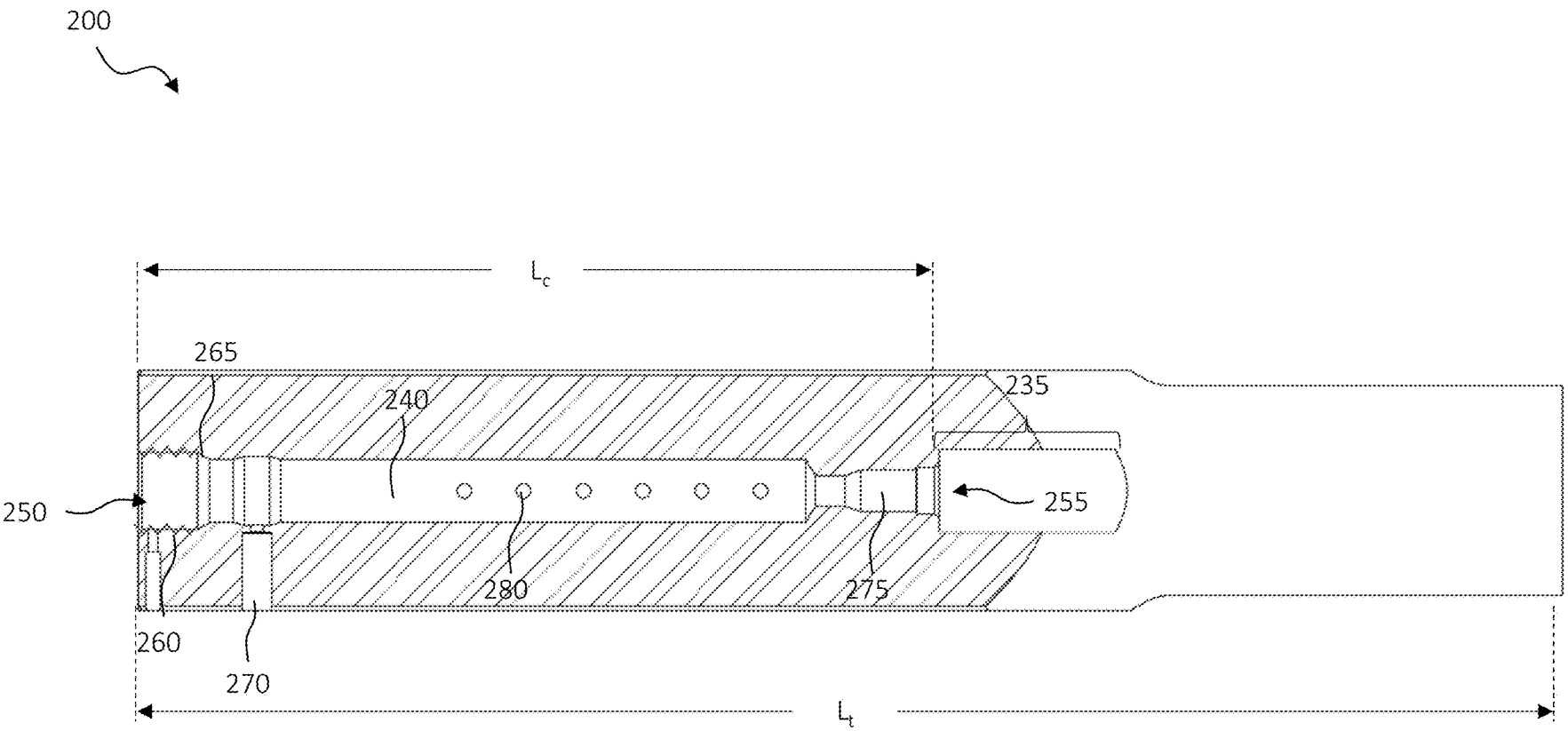

Turning to FIGS. 2A and 2B, illustrated are a cross-sectional view and top view, respectively, of one embodiment of a gauge mandrel 200 designed, manufactured and/or operated according to one or more embodiments of the disclosure. The gauge mandrel 200, in the illustrated embodiment, includes a tubular 210 having a primary fluid passageway 220 extending longitudinally therethrough. In at least one embodiment, the tubular 210 has a length ($L_t$), an internal diameter ($D_i$) and a width (W). The length ($L_t$) may vary greatly and remain within the scope of the disclosure. Nevertheless, in at least one embodiment the length ($L_t$) ranges from 45 cm to 125 cm, and in yet another embodiment the length ($L_t$) ranges from 60 cm to 90 cm. In one or more embodiments, the width (W) is an external diameter ($D_e$), as opposed to a flat or shaved surface, such as shown in FIGS. 2A and 2B. Further to the embodiment of FIGS. 2A and 2B, the internal diameter ($D_i$) and the width (W) define a sidewall thickness (t).

As shown, the sidewall thickness (t) does not need to be consistent all the way around the tubular 210. For example, the tubular 210 may include an upset section 230, thereby providing an inconsistent sidewall thickness (t) around the tubular 210. In at least one embodiment, the upset section 230 creates a clearance 235 for a gauge sensor pressure fitting. For example, in the illustrated embodiment, the gauge mandrel 200 has the upset section 230, such that the primary fluid passageway 220 within the gauge mandrel 200 is not concentric with an exterior of the gauge mandrel 220 in the upset section 230. In accordance with this embodiment, a sidewall thickness ($t_u$) of the upset section 230 is greater than a sidewall thickness ($t_r$) of the remainder of the gauge mandrel 200. In yet another embodiment, the primary fluid passageway 220 and an exterior of the gauge mandrel 200 are concentric with one another, and thus the gauge cavity 240 may be located anywhere in the sidewall thickness (t).

The gauge mandrel 200, in accordance with one or more embodiments, may additionally include a gauge cavity 240 extending along at least a portion of the length ($L_t$) of the tubular 210. The gauge cavity 240 in the illustrated embodiment is located entirely within the sidewall thickness (t) of the tubular 210 and has a gauge cavity length ($L_c$). This is as opposed to a slot, that would be exposed to an outside of the gauge mandrel along at least a portion of the length ($L_t$) of the tubular 210. In at least one embodiment, such as shown, the gauge cavity 240 is located within the greater sidewall thickness ($t_u$) of the upset section 230. The length ($L_c$) may vary greatly and remain within the scope of the disclosure. Nevertheless, in at least one embodiment the length ($L_c$) ranges from 35 cm to 95 cm, and in yet another embodiment the length ($L_c$) ranges from 55 cm to 75 cm.

In one or more embodiments, the gauge cavity 240 includes an insertion end 250 entering the sidewall thickness (t) and configured to accept a gauge sensor. Further to the embodiment of FIGS. 2A and 2B, the gauge cavity 240 may include an exit end 255 exiting the sidewall thickness (t) opposite the insertion end 250. In at least one embodiment, the exit end 255 is operable to allow a pressure nipple of the gauge sensor to extend through the insertion end 250 and exit the gauge cavity 240. In the illustrated embodiment, the length ($L_c$) of the gauge cavity 240 is less than the length ($L_t$) of the tubular 210. For example, in at least one embodiment the length ($L_c$) of the gauge cavity 240 is at least 10 percent less than the length ($L_t$) of the tubular 210. In yet another embodiment, the length ($L_c$) of the gauge cavity 240 is at least 20 percent less, if not at least 30 percent less, than the length ($L_t$) of the tubular 210.

In at least one embodiment, the insertion end 250 includes one or more threads 260 for accepting a gland (not shown) therein. For example, the gland could have associated threads that mate with the one or more threads 260 of the insertion end 250 to hold a related gauge sensor within the gauge cavity 240. While the one or more threads 260 are illustrated in FIG. 2A as the coupling feature, those skilled in the art understand that other coupling features (e.g., a press fit feature, a set screw, etc.) could be used to hold the related gauge sensor within the gauge cavity 240.

The gauge cavity 240, in at least the embodiment shown, includes a gauge mandrel angled surface 265 proximate the insertion end 250. In at least another embodiment, the gauge mandrel angled surface 265 is substantially proximate the insertion end 250. The term proximate, as used with regard to the placement of the gauge mandrel angled surface 265, means within the first 20 percent of the gauge cavity 240. The term substantially proximate, as used with regard to the placement of the gauge mandrel angled surface 265, means within the first 10 percent of the gauge cavity 240. As discussed above, the gauge mandrel angled surface 265 may couple with a gauge sensor angled surface of the gauge sensor that it accepts. Accordingly, the coupling of the gauge mandrel angled surface 265 and the gauge sensor angled surface transfers any stresses from the gauge sensor to the gauge mandrel 200 away from a sensor region of the gauge sensor. Thus, the coupling of the gauge sensor with the gauge mandrel 200 would not impact the accuracy of the gauge sensor. In at least one embodiment, an angle of the gauge mandrel angled surface 265 is slightly mismatched with an angle of the gauge angled surface. For example, in at least one embodiment, the two angles are mismatched by 2 degrees or more, if not 5 degrees or more. As discussed above, the coupling of the gauge sensor with the gauge mandrel 200 may provide a metal to metal seal.

In certain other embodiments, the gauge cavity 240 may have a pressure test port 270 coupling an exterior of the gauge mandrel 200 to the gauge cavity 240, as shown in FIG. 2B. This pressure test port 270, when employed, may be used to pressure test the gauge cavity 240 and all of the associated connections and fittings thereof when the gauge sensor is positioned therein. The gauge cavity 240 may additionally include a second seal profile 275. The second seal profile 275, in at least one embodiment, may be configured to engage with a pressure fitting used to create a seal with the pressure nipple region of a gauge sensor.

In accordance with one embodiment of the disclosure, the gauge mandrel 200 may additionally include one or more fluid passageways 280 coupling the tubular 210 and the gauge cavity 240. In the illustrated embodiment of FIGS. 2A and 2B, the gauge mandrel 200 employs a plurality of fluid ports. For example, the gauge mandrel 200 may include at least three fluid ports, if not at least six fluid ports as shown in FIGS. 2A and 2B. In yet other embodiments, the gauge mandrel 200 may include only a single fluid slot coupling the tubular 210 and the gauge cavity 240. The one or more fluid passageways 280 are shown as multiple drilled ports, however this can be changed from several small diameter ports to fewer large diameter ports or to a long slot to ensure the fluid surrounding the gauge sensor is the same temperature as the fluid in the primary fluid passageway 220. In the illustrated embodiment, the one or more fluid passageways 280 couple the primary fluid passageway 220 of the tubular 210 and the gauge cavity 240 through the sidewall thickness (t).

Figure 3A:
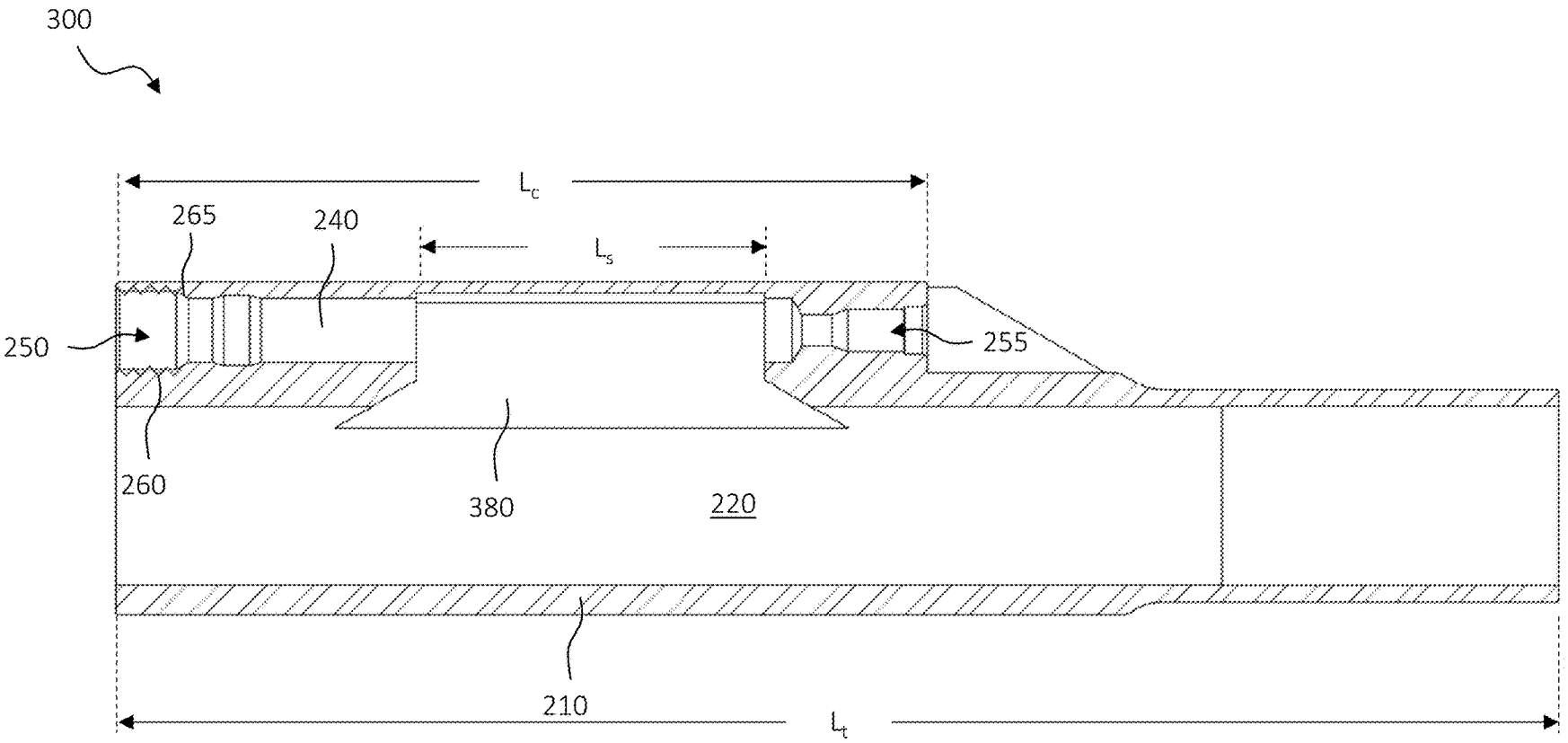
FIGS. 3A and 3B illustrate a cross-sectional view and top view, respectively, of one embodiment of a gauge mandrel designed, manufactured and/or operated according to one or more alternative embodiments of the disclosure.
Figure 3B:
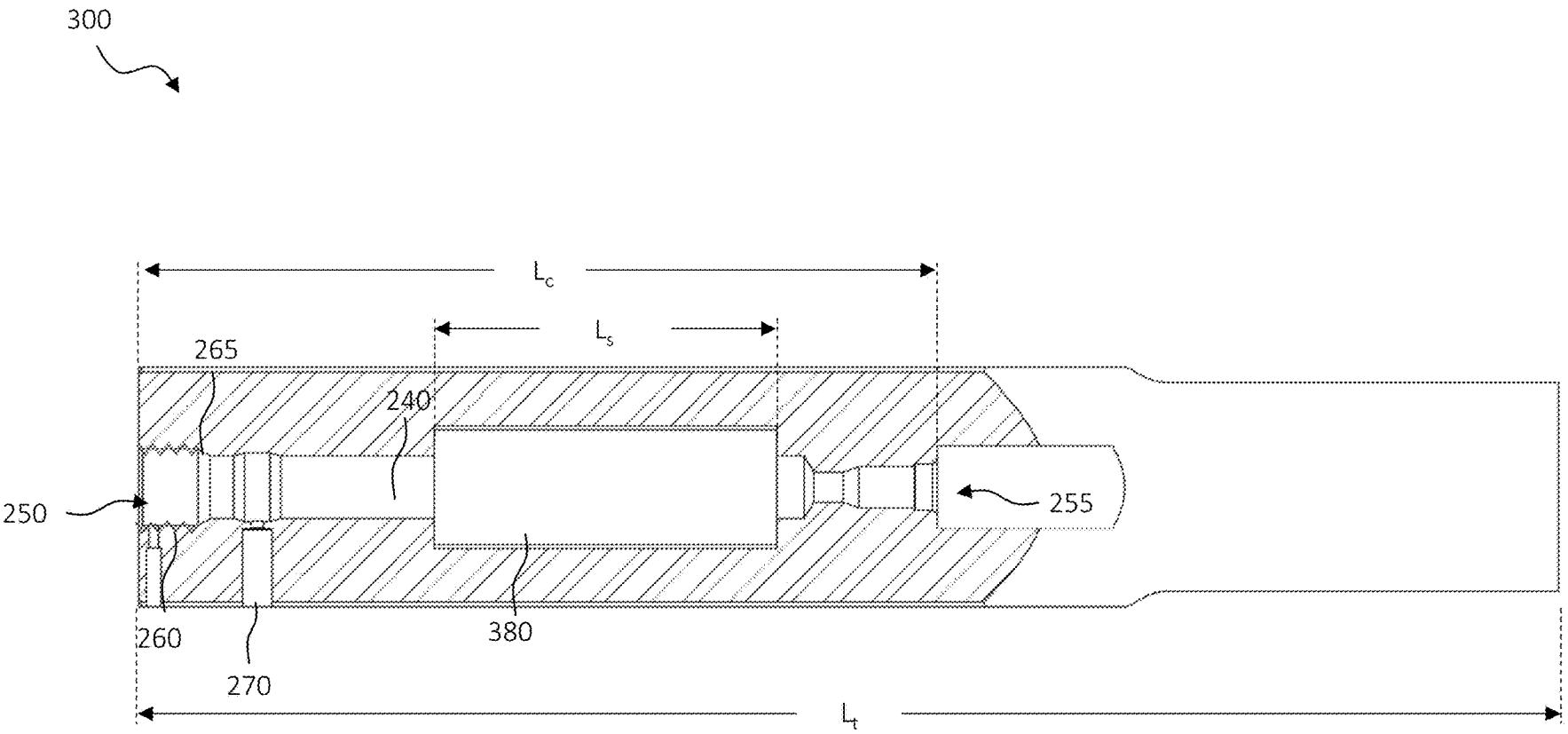

Turning to FIGS. 3A and 3B, illustrated are a cross-sectional view and top view, respectively, of one embodiment of a gauge mandrel 300 designed, manufactured and/or operated according to one or more alternative embodiments of the disclosure. The gauge mandrel 300 is similar in many respects to the gauge mandrel 200 of FIGS. 2A and 2B. Accordingly, like reference numbers have been used to illustrate similar, if not identical, features. The gauge mandrel 300 differs, for the most part, from the gauge mandrel 200 in that the gauge mandrel 300 employs a larger (e.g., single) fluid slot 380 to couple the tubular 210 with the gauge cavity 240. The larger fluid slot 380 allows the fluid from the primary fluid passageways 220 of the tubular 210 to enter and exit the gauge cavity 240 with greater regularity than might be possible with one or more smaller fluid ports, such as shown in FIGS. 2A and 2B. In at least one embodiment, the larger fluid slot 380 has a length ($L_s$) of at least 14 cm. In at least one other embodiment, the larger fluid slot 380 has a greater length ($L_s$) of at least 65 cm.

Figure 4A:
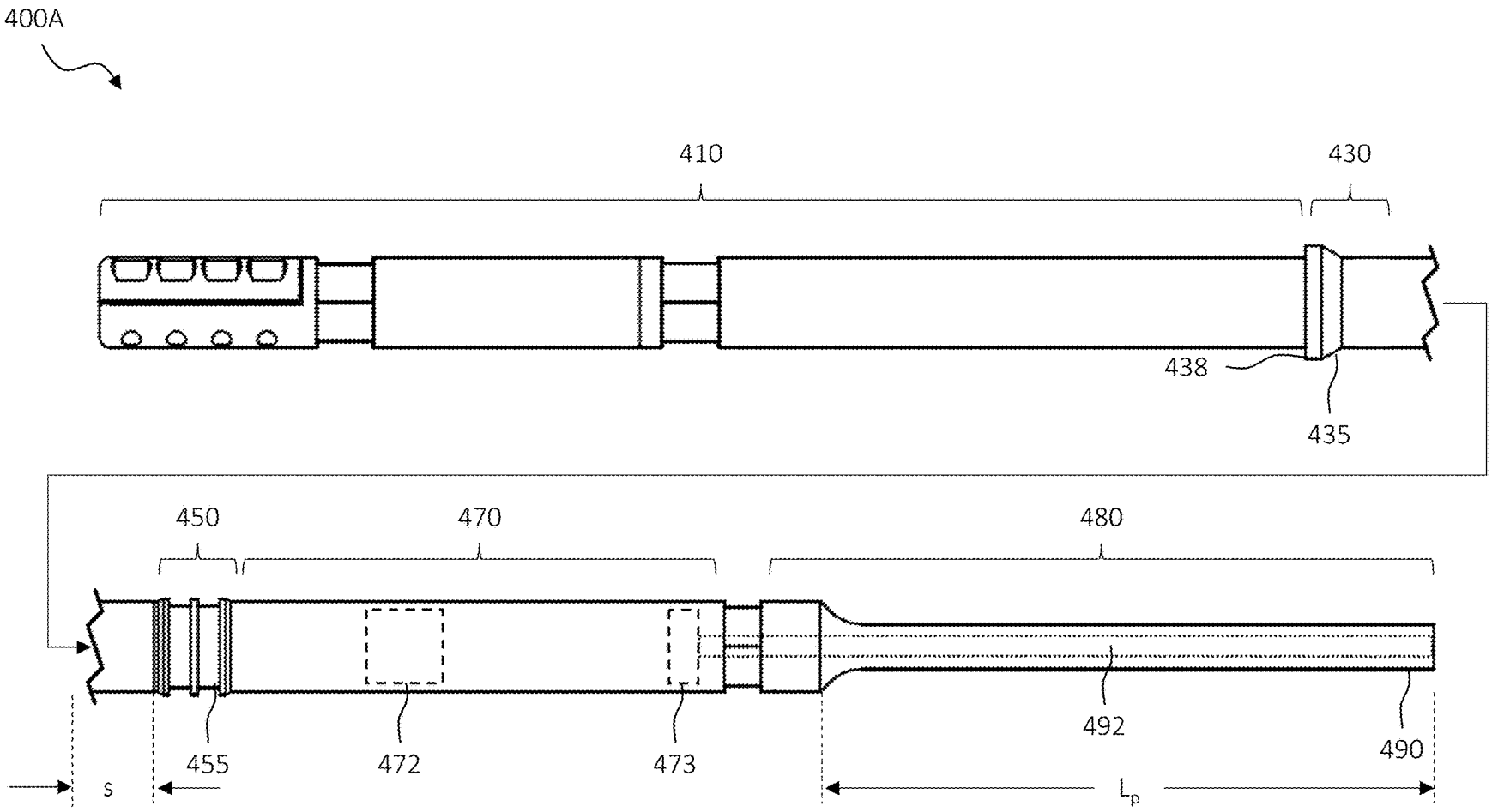
FIGS. 4A through 4E illustrate various different embodiments of a gauge sensor designed, manufactured and/or operated according to one or more embodiments of the disclosure.

Turning to FIG. 4A, illustrated is one embodiment of a gauge sensor 400A designed, manufactured and/or operated according to one or more embodiments of the disclosure. The gauge sensor 400A, in at least one embodiment, might be used with one or more of the gauge mandrels discussed above, among other uses. In the illustrated embodiment, the gauge sensor 400A may be divided into a plurality of different regions, for example including a tubing encapsulated conductor (TEC) termination region 410, a first seal region 430 (e.g., primary seal region), a second seal region 450 (e.g., secondary seal region), a sensor region 470, and pressure nipple region 480. The TEC termination region 410, as those skilled in the art would expect, is configured to provide a termination point with an incoming TEC and the gauge sensor 400A, and thus may include a TEC termination. Nevertheless, any termination may be used and remain within the scope of the disclosure.

The first seal region 430, in at least one embodiment, includes a gauge sensor angled surface 435. As discussed above, the gauge sensor angled surface 435 is configured to couple with a gauge mandrel angled surface (e.g., gauge mandrel angled surface 265) of the gauge mandrel that the gauge sensor is configured to insert within. In at least one embodiment, the gauge sensor angled surface 435 couples with the gauge mandrel angled surface to form a metal to metal seal. The gauge sensor angled surface 435 additionally provides a face 438 that a gland (not shown) may be torqued against to energize the metal to metal seal.

The second seal region 450, in at least one embodiment, includes one or more seal grooves 455. The one or more seal grooves 455, which in the embodiment shown in FIG. 4A are a pair of seal grooves 455, are configured to engage with and position one or more seals (e.g., one or more O-ring seals). Accordingly, the one or more seal grooves 455 may hold the one or more seals in place as the gauge sensor 400A is being positioned within a gauge cavity of an associated gauge mandrel. In this embodiment, the one or more seals would engage with the gauge cavity in the gauge mandrel to provide another seal (e.g., secondary seal). The second seal region 450 enables pressure testing of the assembled tool in the field. In this illustration the seal grooves are O-ring seal grooves, however this can be updated as required for higher temperature rated seals if a secondary seal is required. In at least one embodiment, a spacing (s) between the first seal region 430 and the second seal region 450 ranges from 6 cm to 20 cm. In yet another embodiment, the spacing (s) between the first seal region 430 and the second seal region 450 ranges from 8 cm to 10 cm.

The sensor region 470, in at least one embodiment, is a temperature sensor region including one or more temperature sensors 472. For example, the sensor region 470 could align with the one or more fluid passageways in the gauge mandrel between the tubular and the gauge cavity to measure the temperature of the fluid travelling through the primary fluid passageway of the tubular. Again, in at least one embodiment, the sensor region 470 is spaced apart from the first seal region 430, such that the coupling of the gauge sensor 400 within the gauge mandrel does not impact the accuracy of the gauge sensor 400A. The sensor region 470, in at least one embodiment, may additionally include a first pressure sensor 473. For example, the first pressure sensor 473, depending on the configuration, could be used to measure a pressure of the fluid in the annulus surrounding the gauge mandrel or alternatively used to measure a pressure of the fluid within the gauge mandrel.

The pressure nipple region 480, in at least one embodiment, may be used to help measure the pressure within the annulus surrounding the gauge mandrel or alternatively the pressure of the fluid within the tubular of the gauge mandrel, or in certain embodiments a combination of the two. In the illustrated embodiment of FIG. 4A, the pressure nipple region 480 further includes a pressure nipple 490 having a length ($L_p$), as well as a hollow section 492. In at least one embodiment, the length ($L_p$) is at least 7 cm. In at least one other embodiment, the length ($L_p$) is at least 40 cm. Further, the length ($L_p$) may range from 17 cm to 25 cm. In the illustrated embodiment of FIG. 4A, the hollow section 492 is open at its end (e.g., not capped). Accordingly, in the embodiment of FIG. 4A the first pressure sensor 473 and the hollow section 492 may be used to measure a pressure in the annulus surrounding the gauge mandrel (not shown).

Figure 4B:
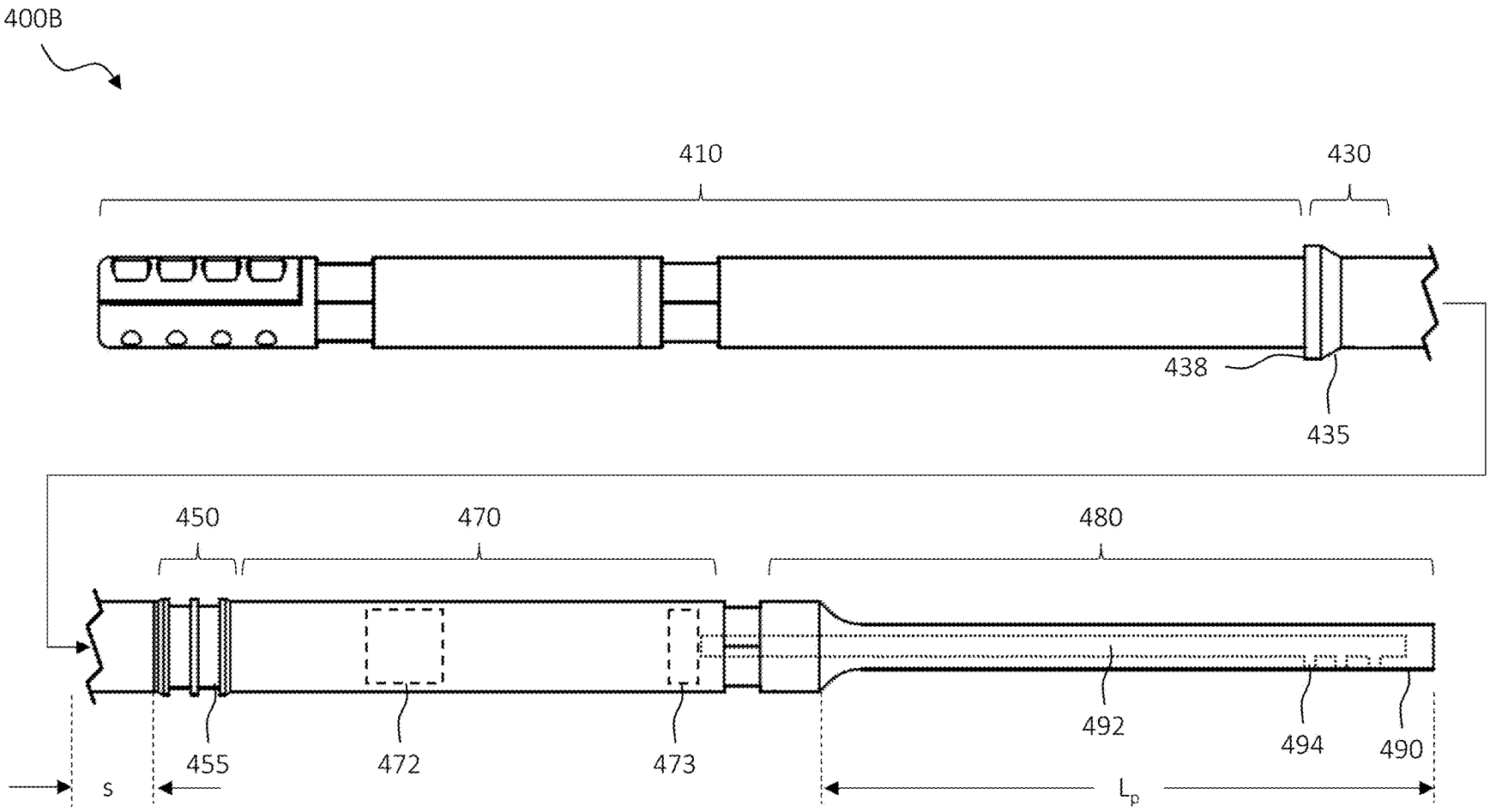

Turning to FIG. 4B, illustrated is one embodiment of a gauge sensor 400B designed, manufactured and/or operated according to one or more alternative embodiments of the disclosure. The gauge sensor 400B of FIG. 4B is similar in many respects to the gauge sensor 400A of FIG. 4A. Accordingly, like reference numbers have been used to indicate similar, if not identical, features. The gauge sensor 400B differs, for the most part, from the gauge sensor 400A, in that the gauge sensor 400B is not open at its end (e.g., it is capped), but further includes one or more sidewall perforations 494 extending into the hollow section 492 proximate the tip of the pressure nipple 490. So long as the one or more sidewall perforations 494 are exposed to the annulus, the pressure sensor 473, the hollow section 492 and the one or more sidewall perforations 494 may be used to measure a pressure in the annulus surrounding the gauge mandrel (not shown). The use of the one or more sidewall perforations 494, as opposed to the use of the open end as shown in FIG. 4A, may be beneficial in preventing unwanted debris from entering the gauge sensor 400B, while still allowing the annulus pressure to be measured.

Figure 4C:
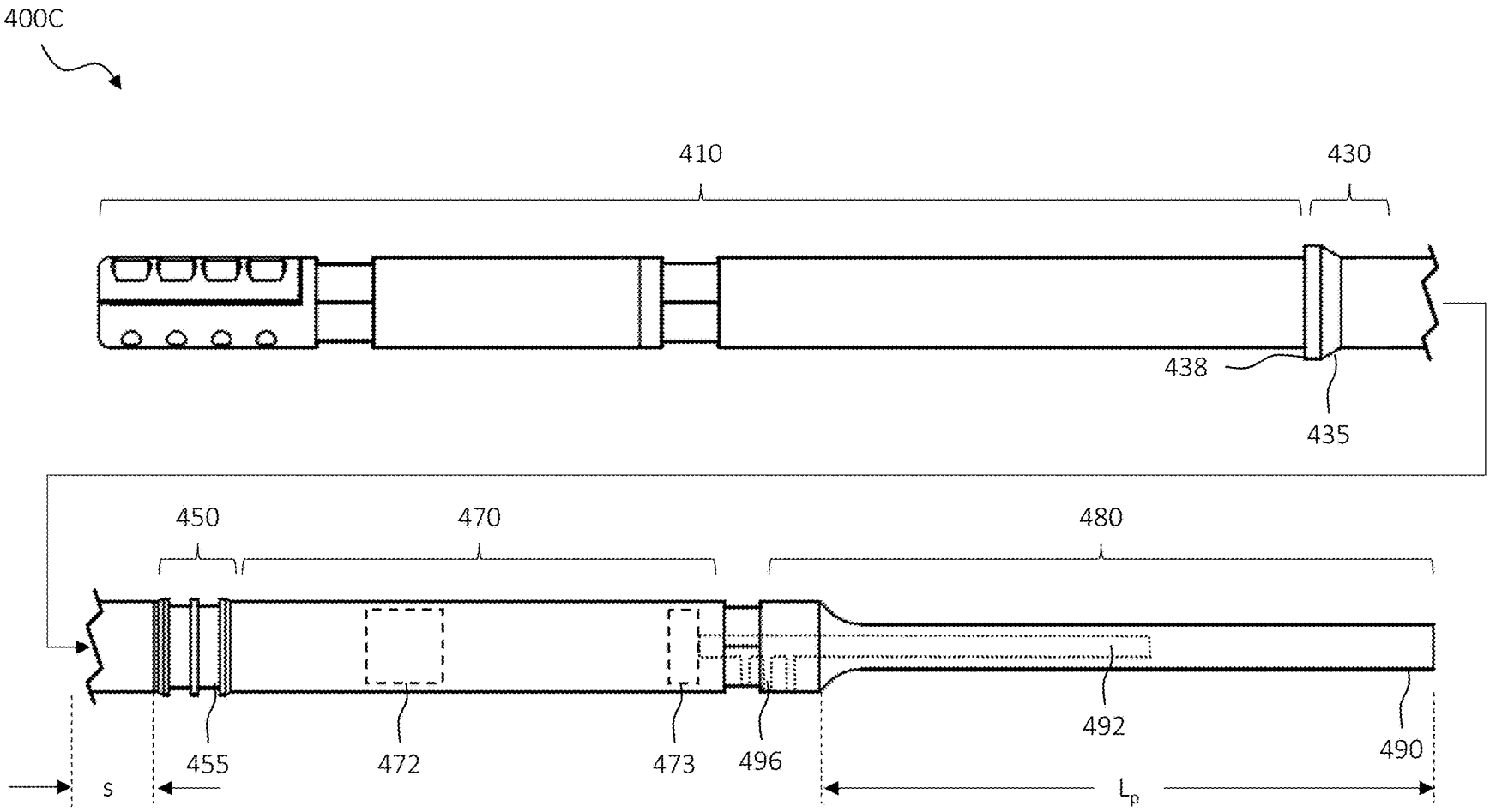

Turning to FIG. 4C, illustrated is one embodiment of a gauge sensor 400C designed, manufactured and/or operated according to one or more alternative embodiments of the disclosure. The gauge sensor 400C of FIG. 4C is similar in many respects to the gauge sensor 400A of FIG. 4A. Accordingly, like reference numbers have been used to indicate similar, if not identical, features. The gauge sensor 400C differs, for the most part, from the gauge sensor 400A, in that the gauge sensor 400C is configured to measure a pressure of the fluid within the tubular of the gauge mandrel. For example, in FIG. 4C, the hollow section 492 is capped at its end, but further includes one or more sidewall perforations 496 extending into the hollow section 492 proximate where the pressure nipple region 480 couples to the sensor region 470. In yet another embodiment, the one or more sidewall perforations 496 extend into the hollow section 492 substantially proximate where the pressure nipple region 480 couples to the sensor region 470. The term proximate, as used with regard to the placement of the one or more sidewall perforations 496, means within the first 20 percent of the pressure nipple 490. The term substantially proximate, as used with regard to the placement of the one or more sidewall perforations 496, means within the first 10 percent of the pressure nipple 490. Thus, in the embodiment of FIG. 4C, the same first pressure sensor 473 may be used to measure the pressure of the fluid within the tubular of the gauge mandrel.

Figure 4D:
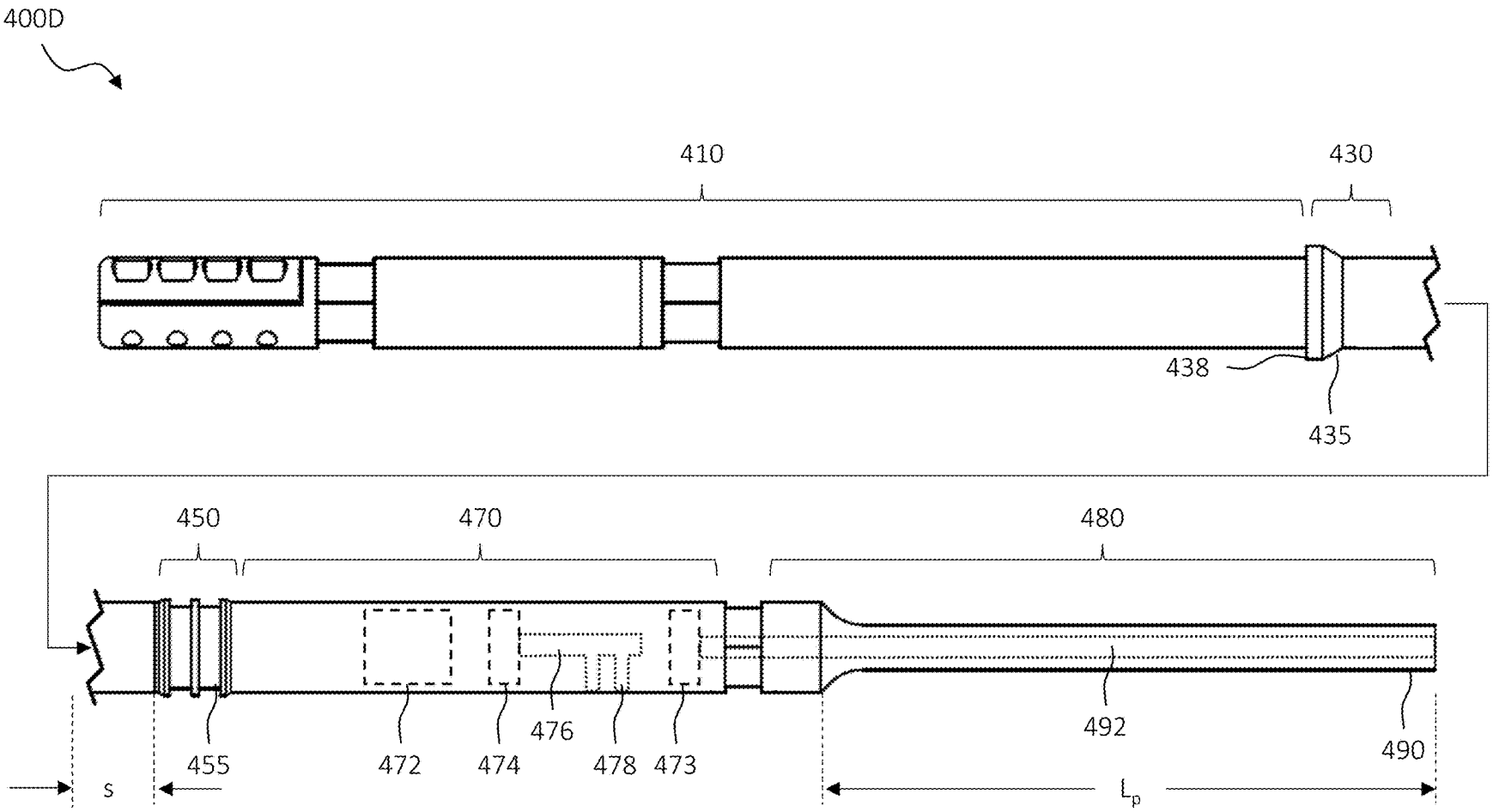
Figure 4E:
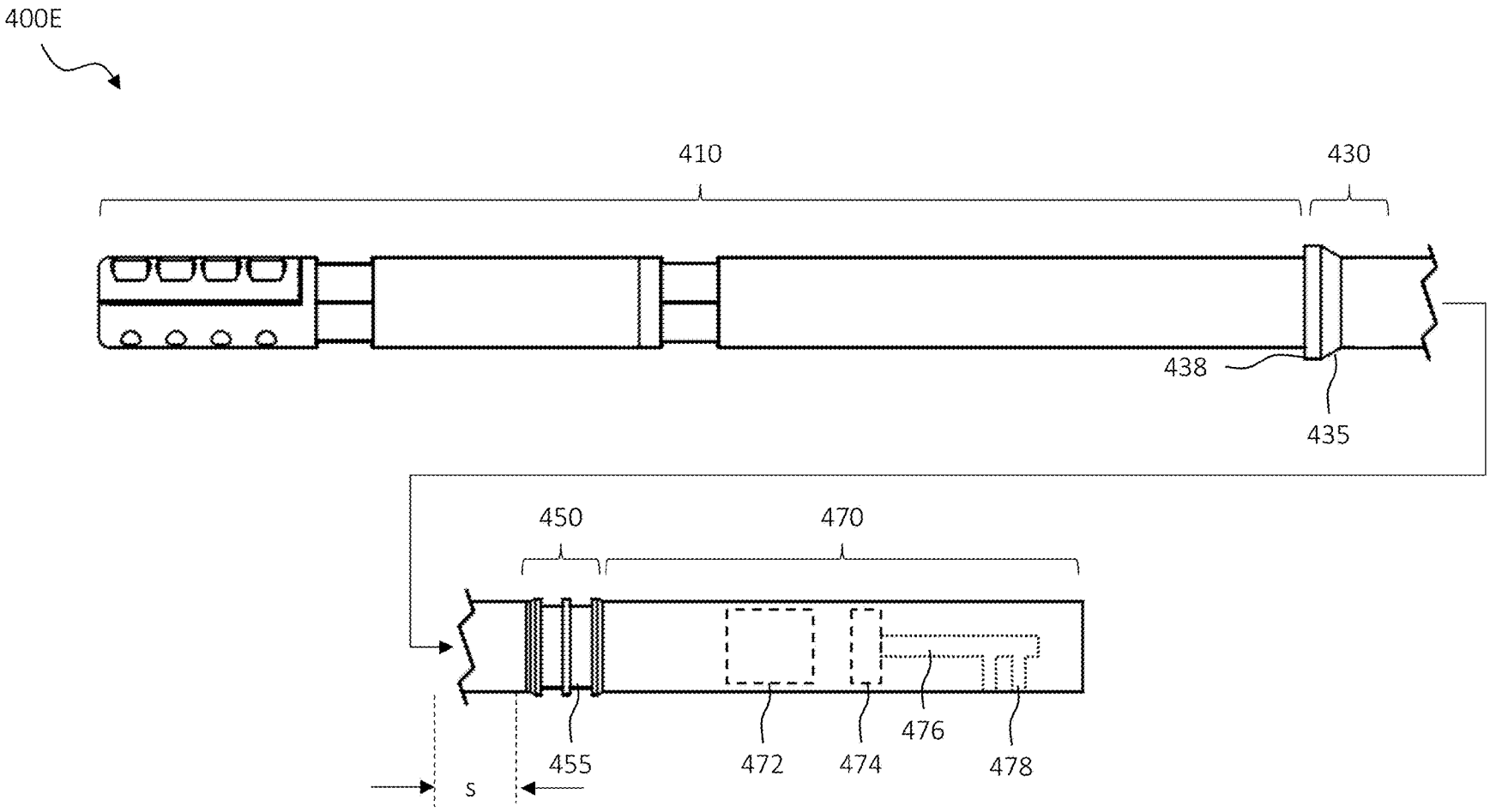

Turning to FIG. 4D, illustrated is one embodiment of a gauge sensor 400D designed, manufactured and/or operated according to one or more alternative embodiments of the disclosure. The gauge sensor 400D of FIG. 4D is similar in many respects to the gauge sensor 400A of FIG. 4A. Accordingly, like reference numbers have been used to indicate similar, if not identical, features. The gauge sensor 400D differs, for the most part, from the gauge sensor 400A, in that the gauge sensor 400D is also configured to measure a pressure of the fluid within the tubular of the gauge mandrel. Thus, in the embodiment of FIG. 4D, the gauge sensor 400D includes a second pressure sensor 474 within the sensor region 470, a second hollow section 476 within the sensor region 470, as well as one or more sidewall perforations 478 extending into the second hollow section 476. Accordingly, in the embodiment of FIG. 4D the second pressure sensor 474, the hollow section 476, and the one or more sidewall perforations 478 may also be used to measure a pressure in the gauge mandrel (not shown). While not shown, the second pressure sensor 474, the hollow section 476, and the one or more sidewall perforations 478 could be also be used with the embodiment of FIG. 4B. Similarly, a gauge sensor could be designed that included the second pressure sensor 474, the hollow section 476, and the one or more sidewall perforations 478 of FIG. 4D, but did not include the pressure nipple region 480. In such an embodiment, the gauge sensor would only measure the fluid temperature and pressure within the gauge mandrel, and would not measure either of the temperature or pressure in the fluid in the annulus. Such an embodiment is illustrated in FIG. 4E.

Figure 5A:
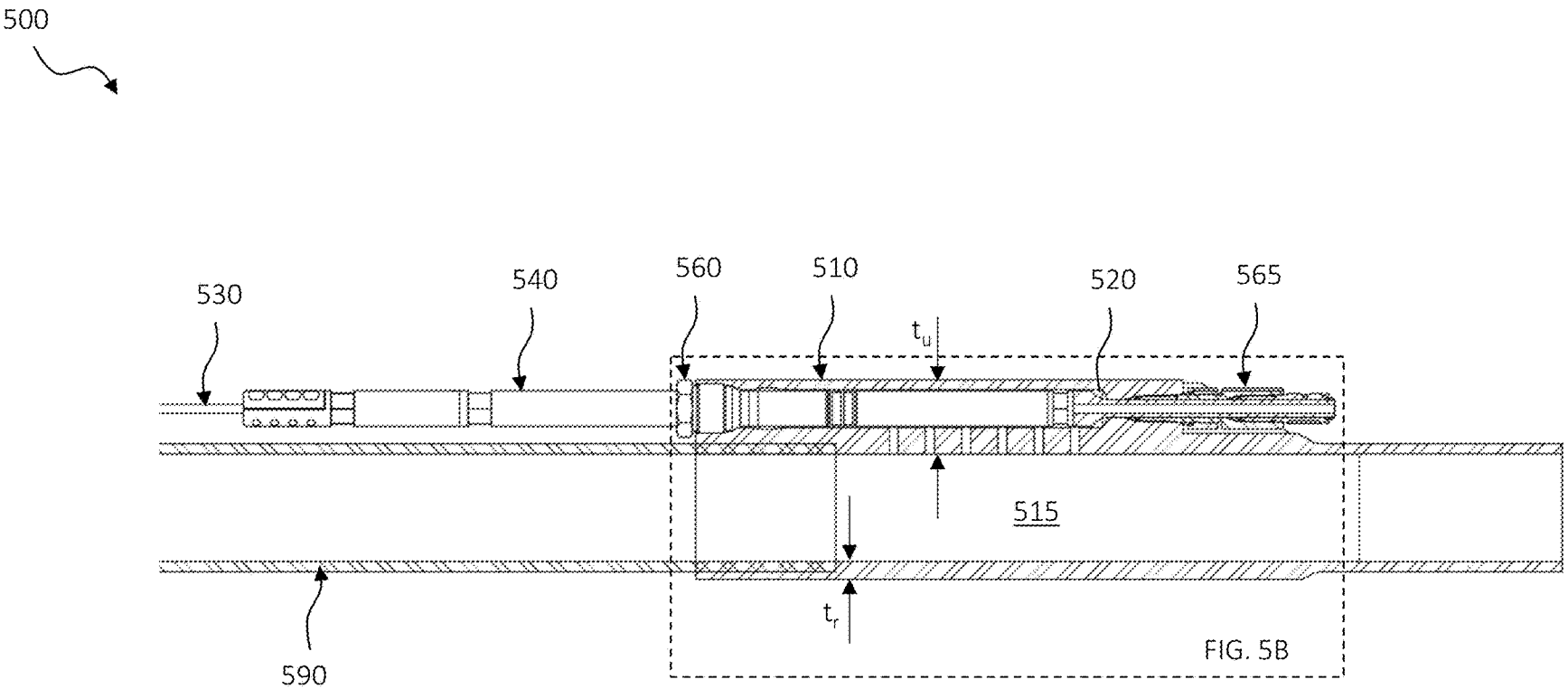
FIGS. 5A to 5E illustrate various different views of sensing system (e.g., installed sensing system) according to any of the embodiments, aspects, applications, variations, designs, etc. disclosed herein.

Turning to FIG. 5A, illustrated is a cross-sectional view of a sensing system 500 (e.g., installed sensing system) according to any of the embodiments, aspects, applications, variations, designs, etc. disclosed herein. In at least one embodiment, the sensing system 500 is located in a wellbore and fluidly coupled to production tubing proximate a submersible pump. In yet another embodiment, the sensing system 500 is located in a wellbore and fluidly coupled to production tubing substantially proximate a submersible pump. The term proximate, as used with regard to the placement of the sensing system 500 relative to the submersible pump, means the sensing system 500 is positioned within 20 meters of the submersible pump. The term proximate, as used with regard to the placement of the sensing system 500 relative to the submersible pump, means the sensing system 500 is positioned within 4 meters of the submersible pump.

The sensing system 500 of the embodiment of FIG. 5A includes a gauge mandrel 510 having a primary fluid passageway 515, the gauge mandrel 510 being coupled to tubing 590 (e.g., production tubing). The sensing system 500 of the embodiment of FIG. 5A additionally includes a gauge sensor 540 located within a gauge cavity 520 in a sidewall thickness (t) of the gauge mandrel 510. In the illustrated embodiment, the gauge mandrel 510 has an upset section, such that the primary fluid passageway 515 within the gauge mandrel 510 is not concentric with an exterior of the gauge mandrel 510 in the upset section. In accordance with this embodiment, a sidewall thickness ($t_u$) of the upset section is greater than a sidewall thickness ($t_r$) of the remainder of the gauge mandrel 510. In at least one embodiment, the gauge cavity 520 is located within the greater sidewall thickness ($t_u$) of the upset section. In yet another embodiment, the primary fluid passageway 515 and an exterior of the gauge mandrel 510 are concentric with one another, and thus the gauge cavity 520 may be located anywhere in the sidewall thickness (t).

The sensing system 500 of the embodiment of FIG. 5A may additionally include a first pressure fitting 560 sealing one end of the gauge sensor 540 within the gauge cavity 520 (e.g., an uphole pressure fitting such as the illustrated seal gland) and a second pressure fitting 565 sealing an opposing end of the gauge sensor 540 within the gauge cavity 520 (e.g., a pressure nipple pressure fitting as illustrated in FIG. 5A). A secondary purpose of the second pressure fitting 565 is to secure the gauge sensor 540 and minimize the potential for damage due to vibration. The seal arrangement (e.g., first pressure fitting 560 and second pressure fitting 565) does not place the gauge sensor 540 under compressive or tensile loading to eliminate the potential for these loads to distort the internal features of the gauge sensor 540, which could compromise the measurement accuracy. The sensing system 500 of the embodiment of FIG. 5A may further include a conductor 530 coupled with the gauge sensor 540. In at least one embodiment, the conductor 530 is a TEC.

Figure 5B:
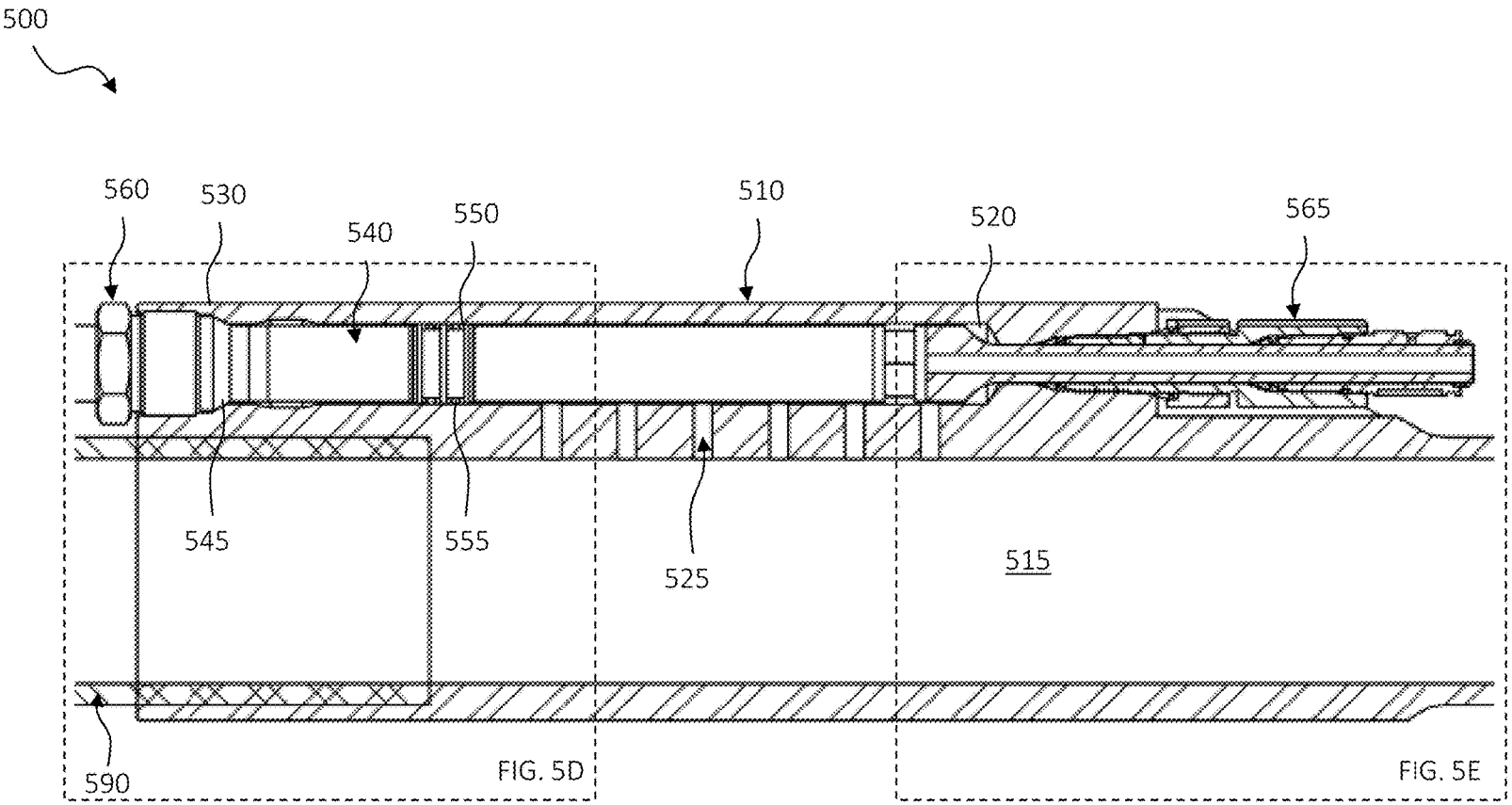

Turning to FIG. 5B, illustrated is a zoomed in cross-sectional view of the sensing system 500 (e.g., installed sensing system) of FIG. 5A according to any of the embodiments, aspects, applications, variations, designs, etc. disclosed herein. As is evident in the embodiment of FIG. 5B, the gauge mandrel 510 may include one or more fluid passageways 525 between the primary fluid passageway 515 and the gauge cavity 520. As is evident in the embodiment of FIG. 5B, the gauge mandrel 510 may additionally include a gauge mandrel angled surface 530.

With continued reference to FIG. 5B, the gauge sensor 540 may include a gauge angled surface 545 that couples with the gauge mandrel angled surface 530 of the gauge mandrel 510, thereby forming a metal to metal seal. As is further evident in the embodiment of FIG. 5B, the gauge sensor 540 may include one or more seal grooves 550 and one or more seals 555, the one or more seal grooves 550 and one or more seals 555 providing a secondary seal for the metal to metal seal. The one or more seal grooves 550 and the one or more seals 555 may additionally create a chamber with the metal to metal seal created with the gauge angled surface 545 and the gauge mandrel angled surface 530 to test the metal to metal seal.

Figure 5C:
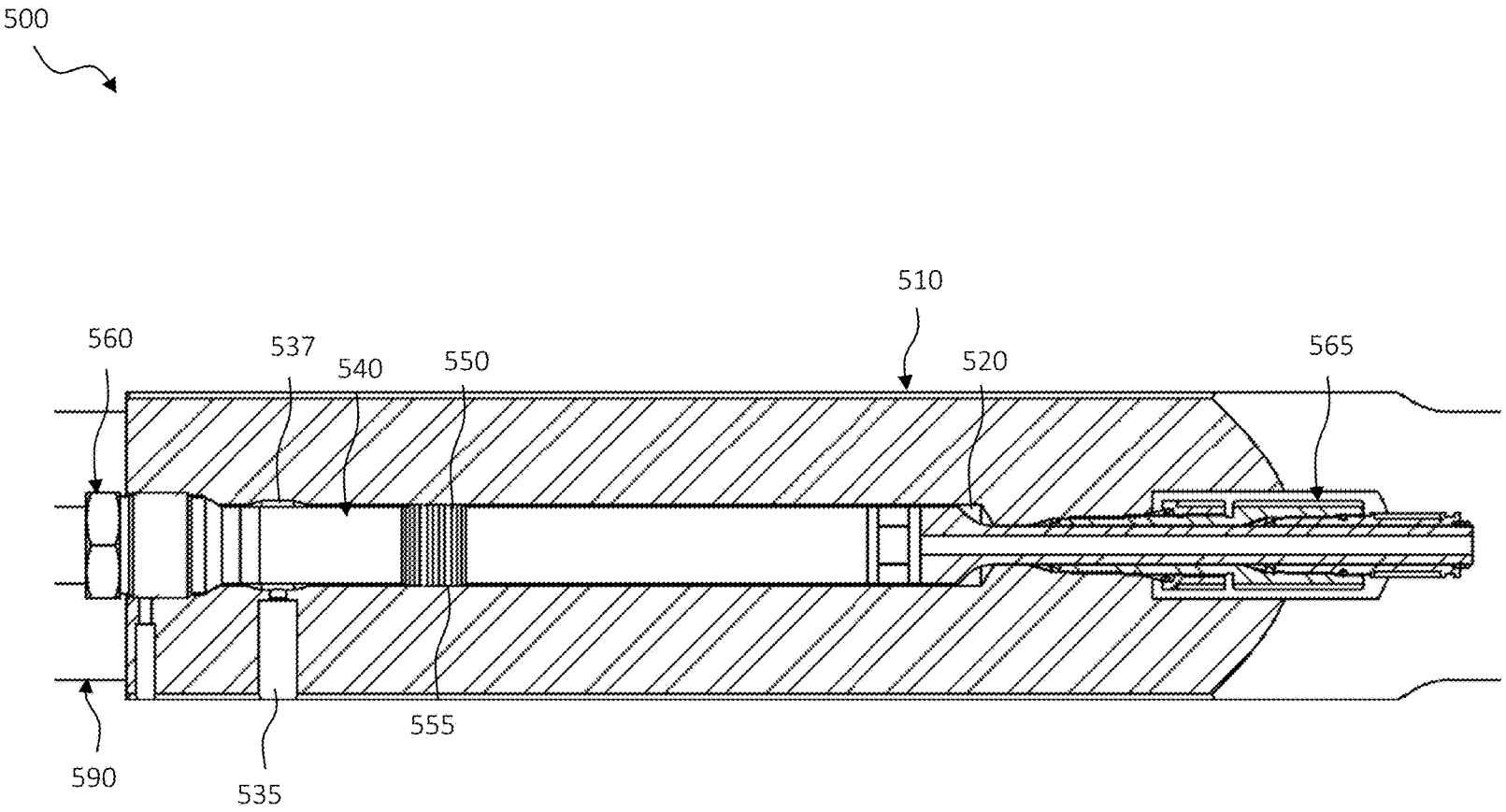

Turning briefly to FIG. 5C, illustrated is a zoomed in top view of the sensing system 500 (e.g., installed sensing system) of FIG. 5B according to any of the embodiments, aspects, applications, variations, designs, etc. disclosed herein. As is illustrated in FIG. 5C, the gauge mandrel 510 may additionally include a pressure test port 535. The pressure test port 535 enables pressure testing in the field without the requirement to pressurize the ID of the gauge mandrel 510. In the embodiment of FIG. 5C, there is an undercut 537 where the pressure test port 535 enters into the gauge cavity 520 to prevent any secondary seals from getting damaged as they are pushed past the pressure test port 535 during installation. Also, a second pressure test port could be located in the downhole seal profile, if it were desirable to test this seal or set of seals as well.

Figure 5D:
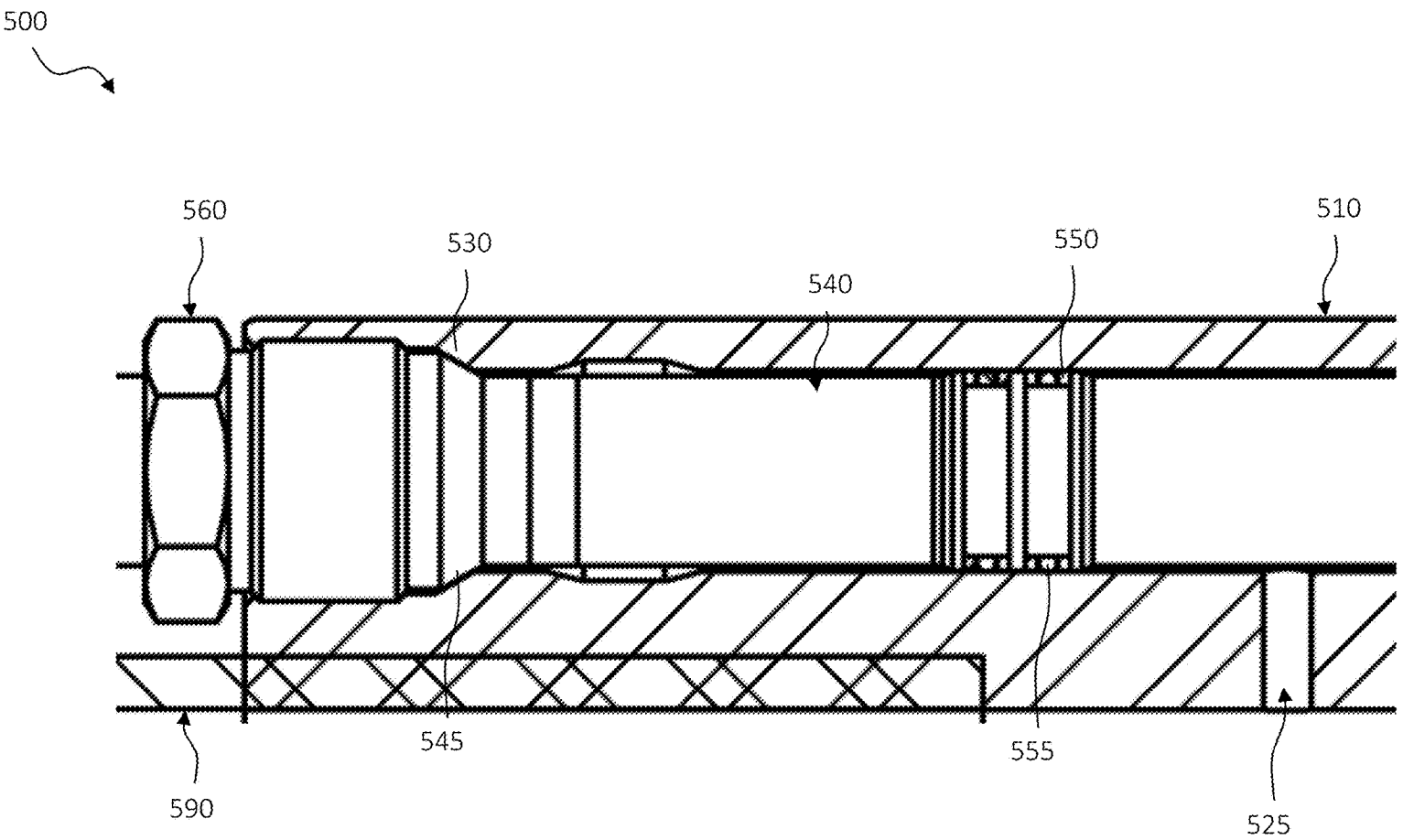

Turning to FIG. 5D, illustrated is a further zoomed in cross-sectional view of the sensing system 500 (e.g., installed sensing system) of FIG. 5B according to any of the embodiments, aspects, applications, variations, designs, etc. disclosed herein. FIG. 5D illustrates an insertion end of the sensing system 500 (e.g., installed sensing system). In the illustrated embodiment, the insertion end includes a primary seal (e.g., metal to metal seal created by the gauge mandrel angled surface 530 and the gauge sensor angled surface 545) and a secondary seal (e.g., created with the seal groove 550 and the one or more seals 555 sealing against the gauge cavity 520). In at least one embodiment, the pressure test port 535 (not shown in this view) may be placed between the primary seal and the secondary seal for testing the sensing system 500. Thus, FIG. 5D illustrates details of the insertion end seals between the Datasphere® ERD™ Gauge and the Datasphere® ERD™ Gauge Mandrel. The gauge mandrel 510 and gauge sensor 540 include at least two novel features. The first feature is the increased OD for the primary seal (e.g., metal to metal seal) which also serves as the face the gland is torqued against to energize the primary seal (e.g., metal to metal seal). The second feature is the one or more seal grooves 550 for the installation of the secondary seals (e.g., seals 555). This enables the primary seal (e.g., metal to metal seal) to be pressure tested through the pressure test port 535 in the gauge mandrel 510. The secondary seals (e.g., O-rings), and one or more seal grooves 550, can be replaced with high temperature seals to function as a secondary seal between the tubing ID and the annulus.

Figure 5E:
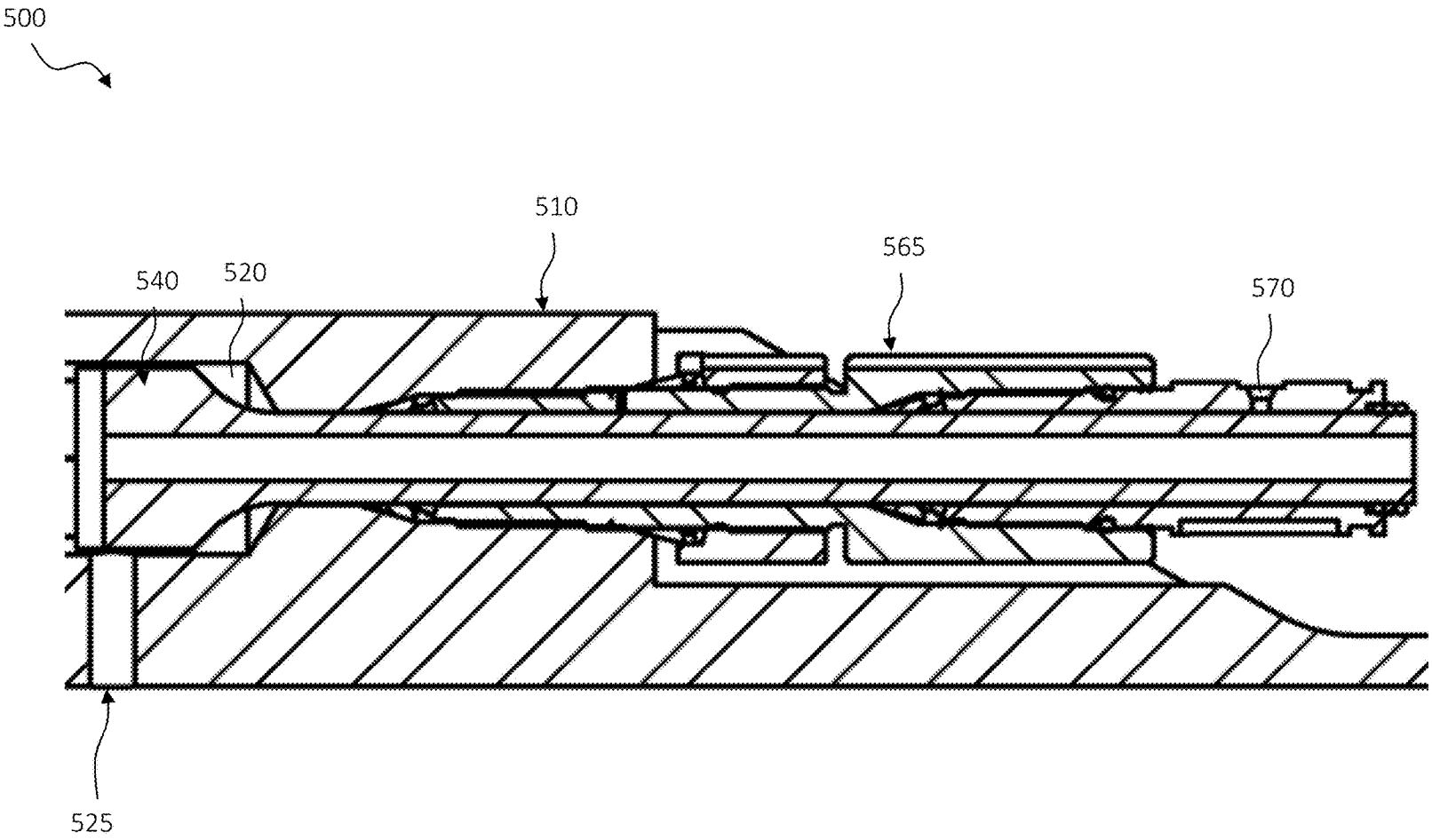
Figure 6A:
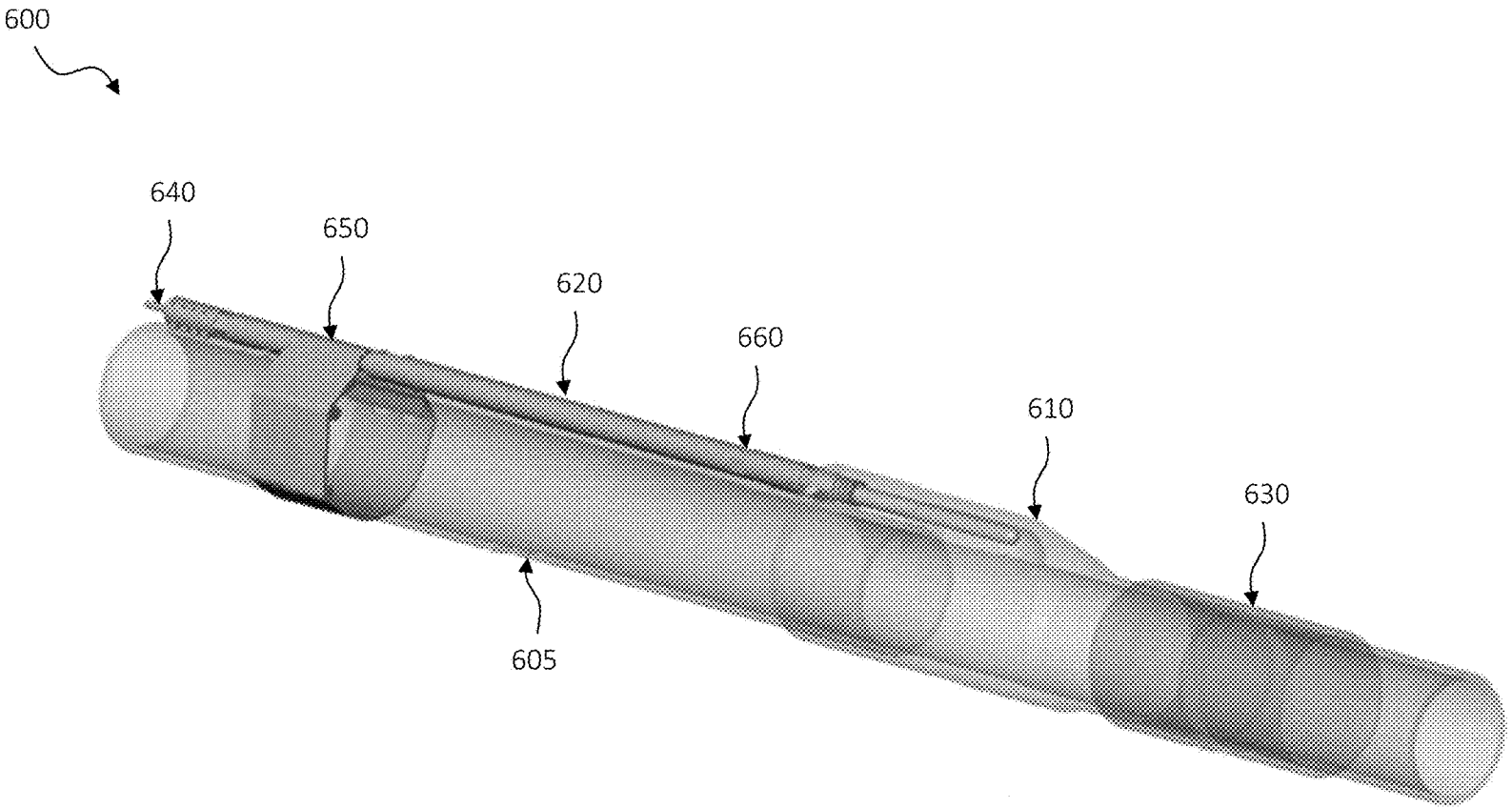
FIGS. 6A to 6D illustrate yet another design of a sensing system designed, manufactured and operated according to one or more embodiments of the disclosure.
Figure 6B:
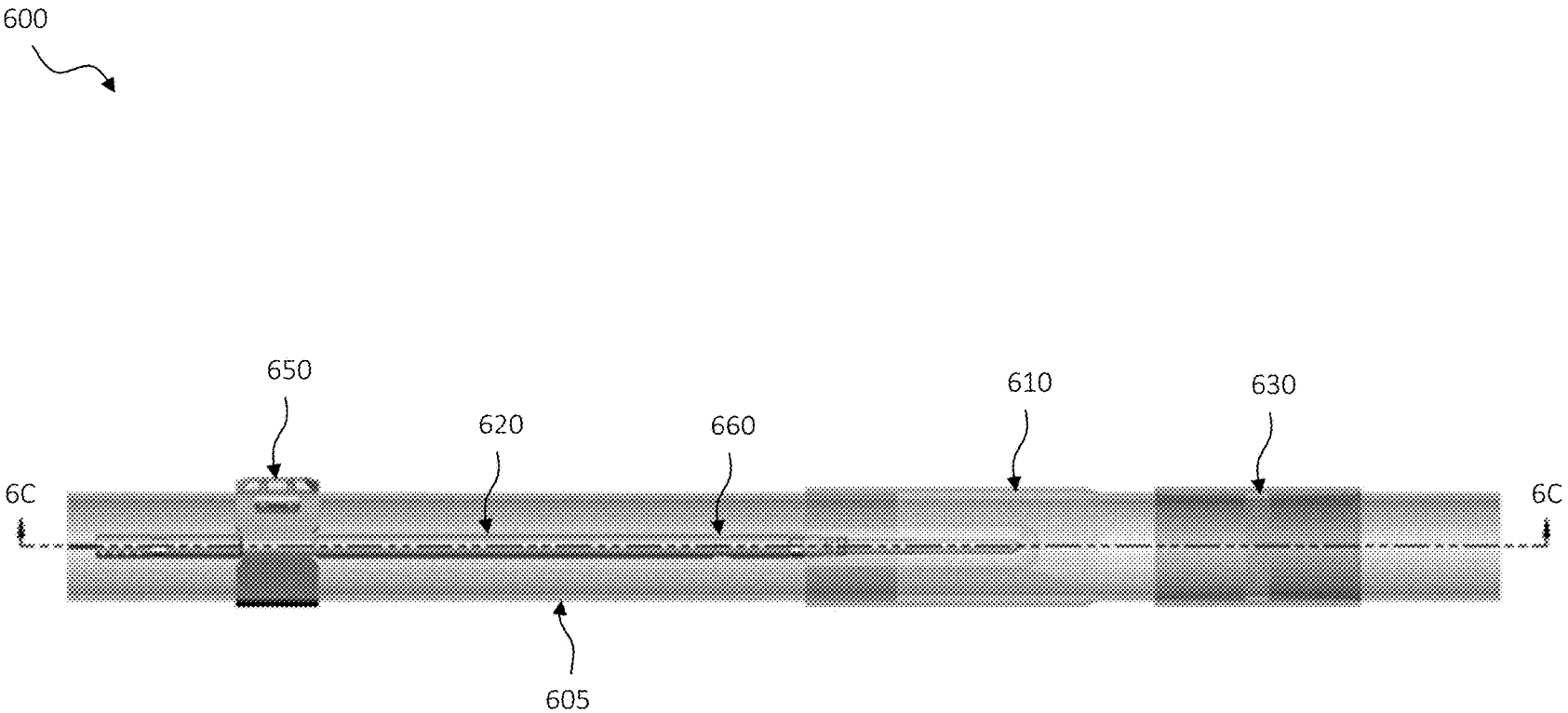
Figure 6C:
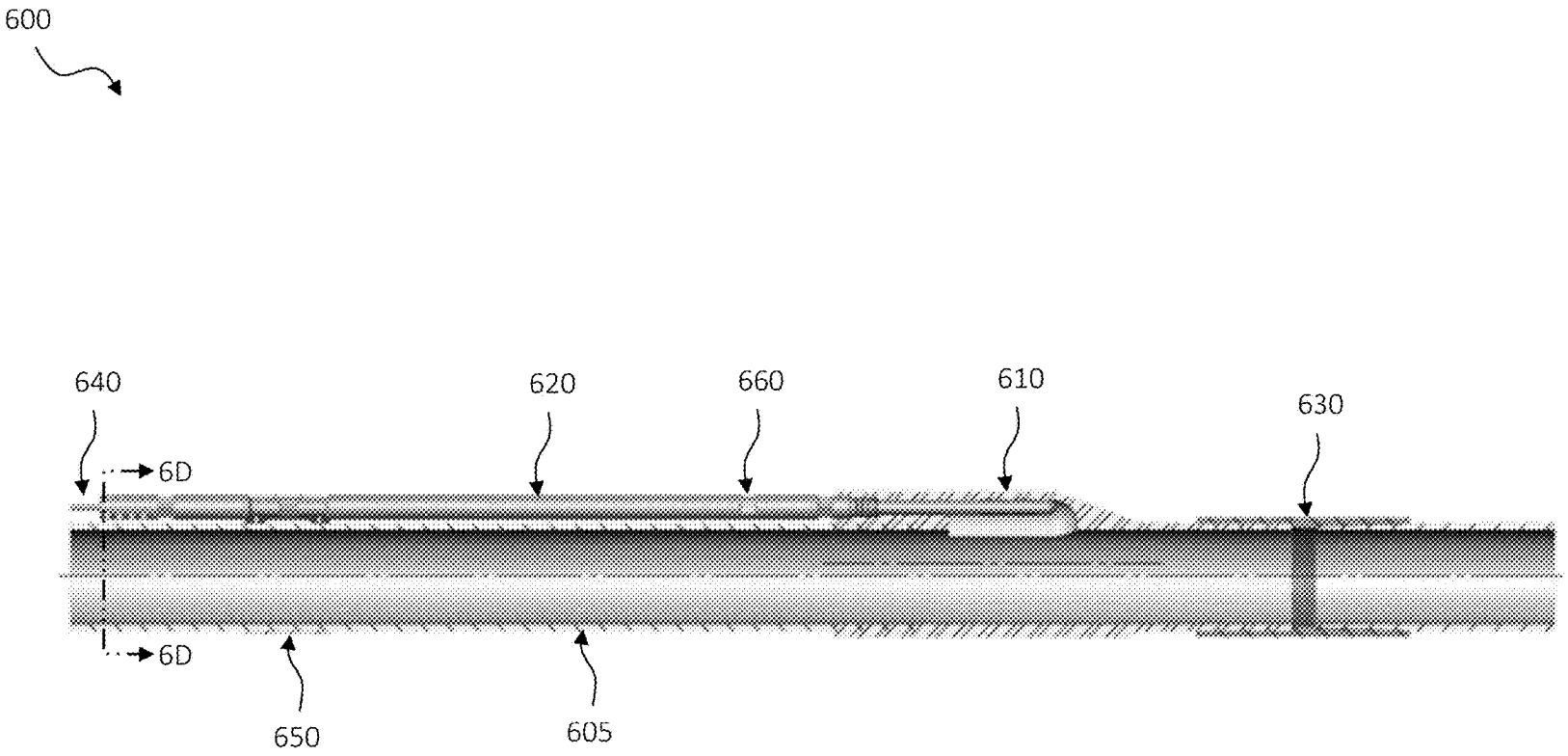
Figure 6D:
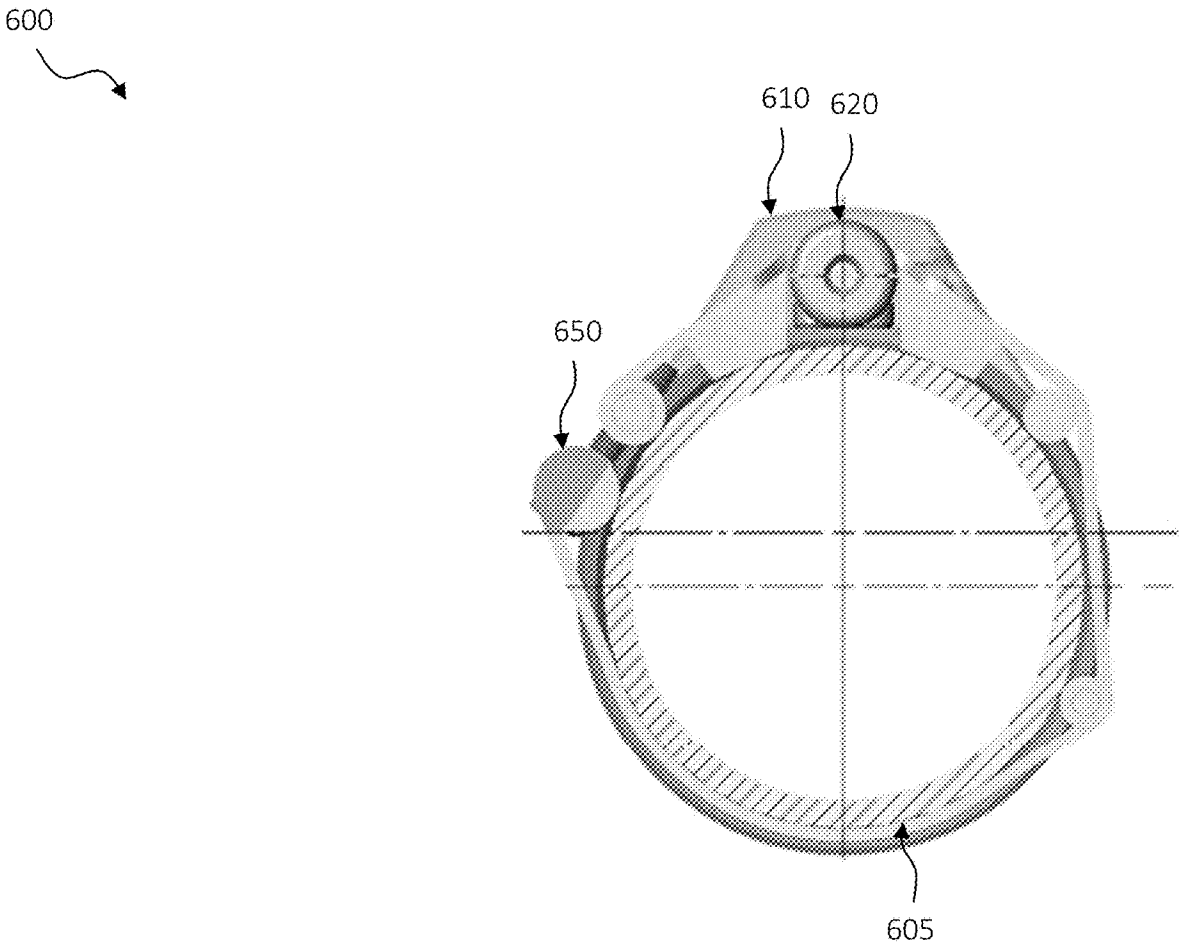

Turning to FIG. 5E, illustrated is a further zoomed in cross-sectional view of the sensing system 500 (e.g., installed sensing system) of FIG. 5B according to any of the embodiments, aspects, applications, variations, designs, etc. disclosed herein. FIG. 5E illustrates an exit end of the sensing system 500 (e.g., installed sensing system). In the illustrated embodiment, the exit end also includes a primary seal (e.g., metal to metal seal between the gauge mandrel 510 and the second pressure fitting 565) and a secondary seal (e.g., O-ring seals). In at least one embodiment, a second pressure test port 570 may be placed between the primary seal and the secondary seal for testing the sensing system. In the embodiment of FIG. 5E, a ½" pressure testable fitting assembly is installed, and the ½" FMJ fitting has redundant metal to metal seals and is pressure testable in the field. FIG. 5E illustrates that the pressure nipple region of the gauge sensor 540 is hollow, thereby enabling the pressure measurement of the annulus surrounding the gauge mandrel 510. In an alternative embodiment, as discussed above, the pressure nipple region may be capped, thus allowing the gauge sensor 540 to measure the pressure in the primary fluid passageway.

FIGS. 6A to 6D illustrates yet another design of a sensing system 600 designed, manufactured and operated according to one or more embodiments of the disclosure. The sensing system 600 may include casing joint 605, a gauge mandrel 610, a gauge sensor 620, and a coupling 630. The sensing system 600 may additionally include a TEC 640, a TEC cable head clamp 650, and in certain embodiments an external pressure port 660. In the embodiment of FIGS. 6A to 6D, a pocket may be machined in the gauge mandrel 610, as shown. Further to the embodiment of FIGS. 6A to 6D, both the temperature and the pressure sensors are within the pocket. Nevertheless, the pressure may be ported to read external pressure. In at least one embodiment, the temperature sensor measures the temperature of the fluid within the casing joint, and thus one or more fluid passageways are formed in the gauge mandrel 610. In at least one embodiment, a seal is created, which is preferably a metal to metal seal, on the housing of the gauge sensor 620 below the TEC cable head clamp 650. Further to the embodiment of FIGS. 6A to 6D, the sensing system 600 may be run decentralized, as it may be one full joint above the ESP.

Alternative embodiments, certain of which are not illustrated, are within the scope of the present disclosure. For example, the following alternative embodiments may be used: Datasphere® Opsis™ Gauge and Gauge Mandrel instead of Datasphere® ERD™ Gauge and Gauge Mandrel; Pressure nipple can have a capped end with perforations to monitor tubing pressure if required; exit end of the mandrel, including the upset, can be lengthened to better protect the fitting assembly; Gauge cavity can be deeper to allow more of the gauge to be installed inside the mandrel. This could better protect the cable termination however it might require additional design modification; Further modifications could enable the use of multi-drop gauges on the same TEC. In this case the TEC to downhole gauges would exit the mandrel instead of the gauge pressure nipple. The easiest application would be for a gauge to monitor tubing pressure. With some additional design work the TEC could exit the gauge from inside the pressure nipple to enable monitoring annulus pressure.

In certain instances, there may be a concern that the temperature sensor will not read the actual fluid temp. For example, there may be a concern that the mass of the gauge mandrel may dampen the fluid temperature response. To address this concern, in at least one or more embodiments, the following changes may be made: 1) Replace the (e.g., vertical) fluid ports spanning between the tubing ID and the gauge cavity with one or more longer slots. 2) Replace the (e.g., vertical) fluid ports spanning between the tubing ID and the gauge cavity with one or more angled fluid ports. 3) Increase the OD, or the ID of the gauge cavity, such that the fluid flows around an entirety of the gauge sensor. 4) Apply insulating coating or "VIT sleeve" around gauge mandrel to minimize the cooling effect of annulus fluid. 5) Place the gauge cavity off center of the tubing sidewall thickness, with the thicker portion closest to the gauge mandrel ID and the thinner portion closest to the tubing ID, thereby providing greater insulation. 6) Trapezoidal gauge cavity for gauge sensor to orient gauge sensor properly. 7) Offset nose to properly align the gauge sensor. Offset nose can also enable the gauge sensor to be installed closer to the tubing ID. 8) Gauge cavity is installed at an angle (e.g., angled toward the tubing ID from the insertion end) to get the gauge sensor closer to the tubing ID. For example, it could be completely across the gauge mandrel. 9) Install gauge sensor in the tubing, for example similar to a pitot tube. 10) Redesign the gauge mandrel with a Bernoulli Tube feature that helps "pump" the fluid around the gauge sensor.

In yet other embodiments, the metal to metal seal design on the top may be changed to use a Ferrule. Also, the pressure testable fitting assembly may be replaced with a seal that can be removed as needed. For example, graphoil packing and annealed copper, compressed with a gland nut, could be used. In another embodiment, the design may allow movement of the gauge sensor relative to the gauge mandrel to accommodate thermal expansion differences. Also, an O-ring or seal stack could be used. Also, the pressure testable fitting assembly could be eliminated downhole, and then the bottom of the gauge sensor could be converted to a 37 degree flare, and thus the gland drives the gauge sensor into the gauge mandrel for sealing. In another embodiment, one could remove the pressure testable fitting assembly from the end, thread nipple, and the nut pulls gauge into the seal. Also, one could redesign the bottom end of the gauge to have a metal to metal seal design.

In another embodiment, the gauge could be installed from inside of the tubing. In yet another embodiment, a longer gauge cavity could be used, and thus the gauge sensor could be installed from the downhole side, pushed out uphole to connect the wire (e.g., TEC), pulled back in and then the fittings made up.

Aspects disclosed herein include:

A. A gauge mandrel for use with a gauge sensor, the gauge mandrel including: 1) a tubular having a length ($L_t$), an internal diameter ($D_i$) and a width (W), the internal diameter ($D_i$) and the width (W) defining a sidewall thickness (t), the tubular defining a primary fluid passageway; and 2) a gauge cavity extending along at least a portion of the length ($L_t$) of the tubular and located entirely within the sidewall thickness (t), the gauge cavity having an insertion end configured to accept a gauge sensor.

B. A sensing system, the sensing system including: 1) tubing; 2) a gauge mandrel coupled to the tubing, the gauge mandrel including: a) a tubular having a length ($L_t$), an internal diameter ($D_i$) and a width (W), the internal diameter ($D_i$) and the width (W) defining a sidewall thickness (t), the tubular defining a primary fluid passageway; and b) a gauge cavity extending along at least a portion of the length ($L_t$) of the tubular and located entirely within the sidewall thickness (t), the gauge cavity having an insertion end; and 3) a gauge sensor positioned at least partially within the gauge cavity, the gauge sensor configured to measure temperatures or pressures within the gauge mandrel or outside of the gauge mandrel.

C. A well system, the well system including: 1) a wellbore located in a subterranean formation; 2) production tubing located in the wellbore; 3) a submersible pump located in the wellbore and fluidly coupled to the production tubing; and 4) a sensing system located in the wellbore and fluidly coupled to the production tubing proximate the submersible pump, the sensing system including: a) a gauge mandrel, the gauge mandrel including: i) a tubular having a length ($L_t$), an internal diameter ($D_i$) and a width (W), the internal diameter ($D_i$) and the width (W) defining a sidewall thickness (t), the tubular defining a primary fluid passageway; and ii) a gauge cavity extending along at least a portion of the length ($L_t$) of the tubular and located entirely within the sidewall thickness (t), the gauge cavity having an insertion end; and b) a gauge sensor positioned at least partially within the gauge cavity, the gauge sensor configured to measure temperatures or pressures within the gauge mandrel or outside of the gauge mandrel.

D. A gauge sensor for use with a gauge mandrel, the gauge sensor including: 1) a tubing encapsulated conductor (TEC) termination region, the TEC region including a TEC termination; 2) a seal region coupled to the TEC region, the seal region including a gauge sensor angled surface configured to couple with a gauge mandrel angled surface of a gauge cavity that the gauge sensor is configured to insert within; 3) a sensor region coupled to the seal region, the sensor region including one or more temperature sensors; and 4) a pressure nipple region coupled to the sensor region, the pressure nipple region including a pressure nipple having a length ($L_p$).

E. A sensing system, the sensing system including: 1) tubing; 2) a gauge mandrel coupled to the tubing, the gauge mandrel having a gauge cavity with an insertion end; and 3) a gauge sensor positioned within the gauge cavity of the gauge mandrel, the gauge sensor including: a) a tubing encapsulated conductor (TEC) termination region, the TEC region including a TEC termination; b) a seal region coupled to the TEC region, the seal region including a gauge sensor angled surface configured to couple with a gauge mandrel angled surface of the gauge cavity; c) a sensor region coupled to the seal region, the sensor region including one or more temperature sensors; and d) a pressure nipple region coupled to the sensor region, the pressure nipple region including a pressure nipple having a length ($L_p$).

F. A well system, the well system including: 1) a wellbore located in a subterranean formation; 2) production tubing located in the wellbore; 3) a submersible pump located in the wellbore and fluidly coupled to the production tubing; and 4) a sensing system located in the wellbore and fluidly coupled to the production tubing proximate the submersible pump, the sensing system including: a) a gauge mandrel, the gauge mandrel having a gauge cavity with an insertion end; and b) a gauge sensor positioned within the gauge cavity of the gauge mandrel, the gauge sensor including: i) a tubing encapsulated conductor (TEC) termination region, the TEC region including a TEC termination; ii) a seal region coupled to the TEC region, the seal region including a gauge sensor angled surface configured to couple with a gauge mandrel angled surface of the gauge cavity; iii) a sensor region coupled to the seal region, the sensor region including one or more temperature sensors; and iv) a pressure nipple region coupled to the sensor region, the pressure nipple region including a pressure nipple having a length ($L_p$).

Aspects A, B, C, D, E and F may have one or more of the following additional elements in combination: Element 1: wherein the gauge cavity has an exit end exiting the sidewall thickness (t) opposite the insertion end, the exit end operable to allow a pressure nipple of the gauge sensor to extend through the insertion end and exit the gauge cavity. Element 2: further including one or more fluid passageways coupling the tubular and the gauge cavity. Element 3: wherein the one or more fluid passageways are a plurality of fluid ports coupling the tubular and the gauge cavity. Element 4: wherein the one or more fluid passageways are a single fluid slot coupling the tubular and the gauge cavity. Element 5: wherein the one or more fluid passageways couple the tubular and the gauge cavity through the sidewall thickness (t). Element 6: further including a gauge mandrel angled surface proximate the insertion end, the gauge mandrel angled surface configured to engage with a gauge sensor angled surface to form a metal to metal seal as the gauge sensor extends through the insertion end of the gauge cavity. Element 7: further including a pressure test port coupling an exterior of the gauge mandrel with the gauge cavity. Element 8: wherein the tubular includes an upset section such that the primary fluid passageway is not concentric with an exterior of the gauge mandrel. Element 9: wherein the gauge cavity is located within the upset section. Element 10: wherein the upset section forms a clearance for a gauge sensor pressure fitting. Element 11: wherein the gauge cavity has an exit end exiting the sidewall thickness (t) opposite the insertion end, and further wherein a pressure nipple of the gauge sensor extends through the insertion end and exits the exit end of the gauge cavity. Element 12: further including a pressure fitting at least partially entering the exit end of the gauge cavity and at least partially surrounding the pressure nipple of the gauge sensor. Element 13: further including a gauge mandrel angled surface proximate the insertion end, the gauge mandrel angled surface configured to engage with a gauge sensor angled surface of the gauge sensor forming a metal to metal seal. Element 14: wherein the seal region is a first seal region, and further including a second seal region positioned between the first seal region and the sensor region. Element 15: wherein the second seal region includes a one or more seal grooves. Element 16: wherein a spacing (s) between the first seal region and the second seal region ranges from 6 cm to 20 cm. Element 17: wherein a spacing (s) between the first seal region and the second seal region ranges from 8 cm to 10 cm. Element 18: wherein the pressure nipple has a hollow section that is open at its end. Element 19: wherein the pressure nipple has a hollow section that is capped at its end, and further includes one or more sidewall perforations extending into the hollow section proximate where the pressure nipple region couples to the sensor region. Element 20: wherein the length ($L_p$) is at least 7 cm. Element 21: wherein the length ($L_p$) is at least 40 cm. Element 22: wherein the length ($L_p$) ranges from 17 cm to 25 cm. Element 23: wherein the gauge cavity has an exit end opposite the insertion end, and further wherein the pressure nipple of the gauge sensor extends through the insertion end and exits the exit end of the gauge cavity. Element 24: further including a pressure fitting at least partially entering the exit end of the gauge cavity and at least partially surrounding the pressure nipple of the gauge sensor. Element 25: wherein the seal region is a first seal region, and further including a second seal region including one or more seal grooves positioned between the first seal region and the sensor region. Element 26: wherein the gauge mandrel includes a pressure test port coupling an exterior of the gauge mandrel with the gauge cavity, the gauge sensor positioned such that the pressure test port is located between the first seal region and the second seal region. Element 27: wherein a spacing (s) between the first seal region and the second seal region ranges from 6 cm to 20 cm. Element 28: wherein the pressure nipple has a hollow section that is open at its end for testing a pressure outside of the gauge mandrel. Element 29: wherein the pressure nipple has a hollow section that is capped at its end, and further includes one or more sidewall perforations extending into the hollow section and in fluid communication with the gauge cavity for testing a pressure of fluid within the gauge cavity.

Those skilled in the art to which this application relates will appreciate that other and further additions, deletions, substitutions and modifications may be made to the described embodiments.

What is claimed is:

1. A gauge mandrel for use with a gauge sensor, comprising:

a tubular having a length ($L_t$), an internal diameter ($D_i$) and a width (W), the internal diameter ($D_i$) and the width (W) defining a sidewall thickness (t), the tubular defining a primary fluid passageway; and a gauge cavity extending along at least a portion of the length ($L_t$) of the tubular and located entirely within the sidewall thickness (t), the gauge cavity having an insertion end configured to accept a gauge sensor, wherein the gauge cavity is located outside of primary fluid passageway, the gauge cavity having an exit end exiting the sidewall thickness (t) opposite the insertion end.

2. The gauge mandrel as recited in claim 1, further including one or more fluid passageways coupling the primary fluid passageway and the gauge cavity.

3. The gauge mandrel as recited in claim 2, wherein the one or more fluid passageways are a plurality of fluid ports coupling the primary fluid passageway and the gauge cavity or a single fluid slot coupling the primary fluid passageway and the gauge cavity.

4. The gauge mandrel as recited in claim 2, wherein the one or more fluid passageways couple the primary fluid passageway and the gauge cavity through the sidewall thickness (t).

5. The gauge mandrel as recited in claim 1, further including a gauge mandrel angled surface proximate the insertion end, the gauge mandrel angled surface configured to engage with a gauge sensor angled surface to form a metal to metal seal as the gauge sensor extends through the insertion end of the gauge cavity.

6. The gauge mandrel as recited in claim 1, further including a pressure test port coupling an exterior of the gauge mandrel with the gauge cavity.

7. The gauge mandrel as recited in claim 1, wherein the tubular includes an upset section such that the primary fluid passageway is not concentric with an exterior of the gauge mandrel.

8. The gauge mandrel as recited in claim 7, wherein the gauge cavity is located within the upset section.

9. The gauge mandrel as recited in claim 7, wherein the upset section forms a clearance for a gauge sensor pressure fitting.

10. A sensing system, comprising:

tubing;

a gauge mandrel coupled to the tubing, the gauge mandrel including:

a tubular having a length ($L_t$), an internal diameter ($D_i$) and a width (W), the internal diameter ($D_i$) and the width (W) defining a sidewall thickness (t), the tubular defining a primary fluid passageway; and a gauge cavity extending along at least a portion of the length ($L_t$) of the tubular and located entirely within the sidewall thickness (t), the gauge cavity having an insertion end, wherein the gauge cavity is located outside of primary fluid passageway, the gauge cavity having an exit end exiting the sidewall thickness (t) opposite the insertion end; and a gauge sensor positioned at least partially within the gauge cavity, the gauge sensor configured to measure temperatures or pressures within the gauge mandrel or outside of the gauge mandrel.

11. The sensing system as recited in claim 10, wherein a pressure nipple of the gauge sensor extends through the insertion end and exits the exit end of the gauge cavity.

12. The sensing system as recited in claim 11, further including a pressure fitting at least partially entering the exit end of the gauge cavity and at least partially surrounding the pressure nipple of the gauge sensor.

13. The sensing system as recited in claim 10, further including one or more fluid passageways coupling the primary fluid passageway and the gauge cavity.

14. The sensing system as recited in claim 13, wherein the one or more fluid passageways are a plurality of fluid ports coupling the primary fluid passageway and the gauge cavity.

15. The sensing system as recited in claim 13, wherein the one or more fluid passageways are a single fluid slot coupling the primary fluid passageway and the gauge cavity.

16. The sensing system as recited in claim 10, further including a gauge mandrel angled surface proximate the insertion end, the gauge mandrel angled surface configured to engage with a gauge sensor angled surface of the gauge sensor forming a metal to metal seal.

17. The sensing system as recited in claim 10, wherein the tubular includes an upset section such that the primary fluid passageway is not concentric with an exterior of the gauge mandrel.

18. The sensing system as recited in claim 17, wherein the gauge cavity is located within the upset section.

19. A well system, comprising:

a wellbore located in a subterranean formation;

production tubing located in the wellbore; a submersible pump located in the wellbore and fluidly coupled to the production tubing; and a sensing system located in the wellbore and fluidly coupled to the production tubing proximate the submersible pump, the sensing system including:

a gauge mandrel, the gauge mandrel including:

a tubular having a length ($L_t$), an internal diameter ($D_i$) and a width (W), the internal diameter ($D_i$) and the width (W) defining a sidewall thickness (t), the tubular defining a primary fluid passageway; and a gauge cavity extending along at least a portion of the length ($L_t$) of the tubular and located entirely within the sidewall thickness (t), the gauge cavity having an insertion end, wherein the gauge cavity is located outside of primary fluid passageway, the gauge cavity having an exit end exiting the sidewall thickness (t) opposite the insertion end; and a gauge sensor positioned at least partially within the gauge cavity, the gauge sensor configured to measure temperatures or pressures within the gauge mandrel or outside of the gauge mandrel.

* * * * *